US005406318A

United States Patent [19]

Moore et al.

[11] Patent Number: 5,406,318

[45] Date of Patent: Apr. 11, 1995

[54] INK JET PRINT HEAD WITH ELECTROPOLISHED DIAPHRAGM

[75] Inventors: John S. Moore, Beaverton; Hue P. Le, Tualatin; J. Kirk McGlothlan, Beaverton, all of Oreg.

[73] Assignee: Tektronix, Inc., Wilsonville, Oreg.

[21] Appl. No.: 716,033

[22] Filed: Jun. 14, 1991

Related U.S. Application Data

[63] Continuation-in-part of Ser. No. 430,213, Nov. 1, 1989, Pat. No. 5,087,930.

[51] Int. Cl.[6] ..... B41J 2/045

[52] U.S. Cl. ..... 347/70; 204/129.1

[58] Field of Search ..... 346/140 R, 75; 204/129.1, 129.75, 129.6, 129.65; 347/70, 68, 71

[56] References Cited

U.S. PATENT DOCUMENTS

| | | | |
|---|---|---|---|
| 2,868,705 | 1/1959 | Baier | 204/129.6 X |
| 3,747,120 | 7/1973 | Stemme . | |
| 4,216,477 | 8/1980 | Matsuda et al. . | |
| 4,266,232 | 5/1981 | Juliana et al. . | |
| 4,312,010 | 1/1982 | Doring . | |
| 4,314,259 | 2/1982 | Cairns | 346/75 |
| 4,435,721 | 3/1984 | Tsuzuki et al. . | |
| 4,454,519 | 6/1984 | Oosaka | 346/140 R |
| 4,460,906 | 7/1984 | Kanayama . | |
| 4,521,788 | 6/1985 | Kimura et al. . | |
| 4,525,728 | 6/1985 | Koto . | |
| 4,528,575 | 7/1985 | Matsuda et al. . | |
| 4,584,590 | 4/1986 | Fischbeck et al. . | |
| 4,599,628 | 7/1986 | Doring et al. . | |
| 4,605,939 | 8/1986 | Hubbard et al. . | |
| 4,635,079 | 1/1987 | Hubbard . | |
| 4,680,595 | 7/1987 | Cruz-Uribe et al. | 346/140 R |
| 4,692,284 | 9/1987 | Braden . | |
| 4,788,556 | 11/1988 | Hoisington et al. . | |
| 4,940,995 | 7/1990 | Hine et al. . | |
| 4,947,184 | 8/1990 | Moynihan | 346/1.1 |
| 4,961,082 | 10/1990 | Hoisington et al. . | |
| 4,995,940 | 2/1991 | Hine et al. . | |
| 5,066,370 | 11/1991 | Andreshak | 204/129.1 |
| 5,087,930 | 2/1992 | Roy | 346/140 R |
| 5,096,550 | 3/1992 | Mayer | 204/129.1 |

OTHER PUBLICATIONS

"Deaeration System for a High-Performance Drop-On-Demand Ink Jet," Nathan P. Hine, Nov. 1989, Fifth International Congress on Advances in Non-Impact Printing Technologies.

*Primary Examiner*—Joseph W. Hartary
*Attorney, Agent, or Firm*—Ralph D'Alessandro

[57] ABSTRACT

The present invention provides an ink jet print head having an improved driver design and capable of extended and continuous periods of operation with substantially reduced rectified diffusion-induced printing quality degradation. In preferred ink jet print heads of the present invention, the ink-contacting portion of the surface of the diaphragm of a piezoelectric ceramic/diaphragm drive mechanism is electropolished. By electropolishing only a portion of one surface, the ink-contacting surface, of one ink jet print head component, rectified diffusion is greatly reduced.

14 Claims, 16 Drawing Sheets

INK JET PRINT HEAD WITH ELECTROPOLISHED DIAPHRAGM

RELATED APPLICATION

This application is a continuation-in-part of U.S. patent application Ser. No. 07/430,213 of Joy Roy and John S. Moore filed Nov. 1, 1989, now U.S. Pat. No. 5,087,930, issued Feb. 11, 1992.

TECHNICAL FIELD

The present invention relates to ink jet print heads that are less susceptible to print quality degradation resulting from rectified diffusion, an undesirable phenomenon that occurs as a result of repeated application of pressure pulses to ink located within ink pressure chambers of ink jet print heads. More particularly, the present invention relates to ink jet print heads, where only print head surfaces that contact the ink to apply pressure pulses are treated to reduce the density of surface defects thereof.

BACKGROUND OF THE INVENTION

Ink jet printers, in particular drop-on-demand (DOD) or impulse printers having ink jet print heads with acoustic drivers to accomplish ink drop formation, are well known in the art. For example, ink jet print head designs, in which ink is ejected from the print head in a direction perpendicular to the plane of one or more ink pressure chambers, are disclosed in U.S. Pat. No. 4,266,232 issued to Juliana, Jr. et al.; U.S. Pat. No. 4,312,010 issued to Doring; U.S. Pat. No. 3,747,120 issued to Stemme; U.S. Pat. No. 4,599,628 issued to Doring et al.; U.S. Pat. No. 4,680,595 issued to Cruz-Uribe et al.; and U.S. Pat. No. 4,460,906 issued to Kanayama. Print head designs that eject ink in a direction parallel to the plane of one or more ink pressure chambers are disclosed, for example, in U.S. Pat. No. 4,216,477 issued to Matsuda et al.; U.S. Pat. No. 4,525,728 issued to Koto; U.S. Pat. No. 4,584,590 issued to Fishbeck et al.; U.S. Pat. No. 4,435,721 issued to Tsuzuki; U.S. Pat. No. 4,528,575 issued to Matsuda; U.S. Pat. No. 4,521,788 issued to Kamura and D. E. Patent No. 3,427,850 issued to Yamamuro.

The principle underlying the successful operation of an ink jet print head of this type is the manipulation of pressure within an ink pressure chamber to achieve controlled emission of ink droplets from the chamber through a nozzle orifice or ink drop ejection orifice outlet. In general, a DOD ink jet print head, having an ink pressure chamber coupled to a source of ink and an ink drop ejecting orifice terminating in an ink drop ejection orifice outlet, is operated as set forth below. An acoustic driver expands and contracts the volume of the ink pressure chamber to eject a drop of ink from the orifice outlet. More specifically, the acoustic driver applies a pressure wave to the ink residing within the ink pressure chamber to cause the ink to pass outwardly through the orifice and through the orifice outlet in a controlled manner.

In the prior art, a number of different acoustic drivers have been employed to generate a pressure wave in DOD ink jet print heads. For example, drivers consisting of a pressure transducer formed by bonding a piezoelectric ceramic material to a thin diaphragm have been utilized for this purpose. In response to an applied voltage, the piezoelectric ceramic material deforms and causes the diaphragm to deflect and displace ink in the ink pressure chamber, which displacement results in a pressure pulse or pulse train and, ultimately, the flow of ink through one or more nozzles.

Prior art piezoelectric ceramic drivers have been formed in a variety of shapes, such as circular, polygonal, cylindrical, and annular-cylindrical. In addition, prior art piezoelectric ceramic drivers have been operated in various modes of deflection, such as bending mode, shear mode, and longitudinal mode. Other types of prior art acoustic drivers for generating pressure waves in ink include heater-bubble source drivers (for bubble or thermal ink jet print heads) and electromagnet-solenoid drivers. In general, it is desirable in an ink jet print head to employ a geometry that permits multiple nozzles to be positioned in a densely packed array, with each nozzle being driven by an associated acoustic driver.

Prior art ink jet print heads have experienced difficulty with degradation in printing quality resulting from rectified diffusion. Rectified diffusion occurs after a period of continuous ink jet print head operation as a consequence of the repeated application of pressure pulses, at below ambient pressure, to ink located within the ink pressure chamber. The threshold at which rectified diffusion occurs is dependent upon a number of factors, such as drive pulse shapes and durations, absorbed gas concentrations, temperature, particulate matter (e.g., pigment particles present in the ink) and roughness of the driver surface. The length of time before the onset of printing quality degradation depends on the drop generation rate and, prior to the initiation of repetitive ink jet print head operation, on the amount of air dissolved in the ink, the presence of particulates in the ink, the ink viscosity, the ink density, the diffusivity of air in the ink, and the radii of air bubbles present, if any, in the ink.

As discussed above, ink jet print head designs employing piezoelectric ceramic material deformation/-diaphragm deflection operations are characterized by contractions and expansions of ink pressure chamber volume which generate pressure pulses in ink contained in the chamber. Contractions occur rapidly and are preceded and/or followed by rapid expansions of ink pressure chamber volume. During the expansion phase, the pressure in the ink pressure chamber is reduced significantly, increasing the tendency to bubble formation at the chamber surface by air dissolved in the ink. The tendency to bubble formation is highest at nucleation sites on the ink pressure chamber surface where gases may be retained. Nucleation sites include, for example, corners, edges, points, cracks, pits or foreign particle deposits.

In ink characterized by exceeding the condition-dependent rectified diffusion threshold, pressure pulse application results in the formation and/or growth of air bubbles disposed in the ink, rather than oscillation of air bubble size about a mean value. Specifically, more gas is added to the air bubbles during negative pressure (below ambient) applications than is re-absorbed into the surrounding liquid during positive pressure (above ambient) applications. If conditions favorable to air bubble growth persist, large air bubbles will be formed in the ink contained within the pressure chamber.

Gas bubbles in the ink absorb energy supplied to the ink in the ink pressure chamber. As the gas bubbles grow, they absorb more of the energy supplied by the acoustic drivers. When the bubbles attain a large enough size, they absorb so much energy that ink drops cannot be ejected from the nozzles in the ink jet print head at appropriate speeds or volumes through the action of the acoustic driver. If the condition-dependent rectified diffusion threshold is exceeded for a time period exceeding that required for the onset of printing quality degradation, itself a condition-dependent parameter, the prints generated by the ink jet print head will suffer from inexact ink drop ejection.

Rectified diffusion is a recognized problem in the ink jet printing art. As a result, numerous approaches have been employed in an effort to mitigate or alleviate the problem. For example, U.S. Pat. No. 4,947,184 issued to Moynihan discusses coating the entire pressure chamber of an ink jet print head with a smooth, conforming coating layer of material that is wettable by the ink to be contained therewithin. The use of a coating with a surface energy greater than that of the ink is preferred to promote wetting. The smooth coating layer is applied to fill in or otherwise decrease the number of nucleation sites located on pressure chamber surfaces. This prior art coating process is conducted following assembly of the ink jet print head, possibly introducing contamination into the jet, clogging the small passages of the jet, or causing some of the acoustic energy to be absorbed through the addition of such energy-absorbing materials to pressure chamber surfaces.

At the Fifth International Congress on Advances in Non-impact Printing Technologies held in November 1989, Spectra Inc. described a de-aeration process for a DOD ink jet printer. In this technique, the concentration of gas dissolved in the ink, one factor in determining the rectified diffusion and degradation onset time thresholds, is decreased. This decrease in dissolved gas was indicated to alleviate the rectified diffusion problem.

SUMMARY OF THE INVENTION

The present invention provides ink jet print heads capable of printing for an extended period of time, with little or no print quality degradation resulting from rectified diffusion. The ink jet print heads of the present invention may even be used in combination with gas-saturated inks. An embodiment of the present invention exhibits this print quality improvement over a wide range of drop repetition rates. The present invention also provides methods for making an ink jet print head capable of printing with reduced rectified diffusion-induced print quality degradation.

Ink jet print heads of the present invention include an improved driver component incorporating an electropolished ink-contacting surface. Similar to prior art acoustic driver designs, a preferred driver of the present invention includes a piezoelectric ceramic portion and a diaphragm. In contrast to prior art designs, the surface of the preferred diaphragm or other driver-associated component portion that contacts the ink to apply pressure thereto is electropolished. The electro-polished surface of the preferred diaphragm is disposed oppositely to the surface thereof that is adjacent to the piezoelectric ceramic portion and forms one wall of an ink pressure chamber.

The benefits of the present invention are therefore achieved through the simple process of electropolishing one surface of one component of the ink jet print head. Electropolishing is conducted prior to ink jet print head assembly. As a result, no contaminants are introduced into the print head, and no clogging of small cross-section ink passages takes place. Further, no acoustic energy absorbing materials are added to the pressure chamber surfaces during electropolishing. Electropolishing reduces the density of pressure-applying ink-contacting surface defects, thereby reducing the number of nucleation sites available for gas bubble formation. This reduction in surface defect density substantially eliminates printing quality degradation resulting from rectified diffusion. Moreover, electropolishing as little as from about 1 to about 2 micrometers of the diaphragm or other pressure-applying ink-contacting surface suffices to produce an embodiment of the present invention which exhibits reliable operation over thousands of copies.

The present invention also provides an improved electropolishing method. Electropolishing using an electropolishing bath in accordance with the present invention results in a more uniformly polished surface upon application of lower current densities.

Additional features and advantages of the present invention will be apparent from the following detailed description of preferred embodiments thereof, which proceeds with reference to the accompanying drawings.

DETAILED DESCRIPTION OF PREFERRED EMBODIMENTS

Figure 1:
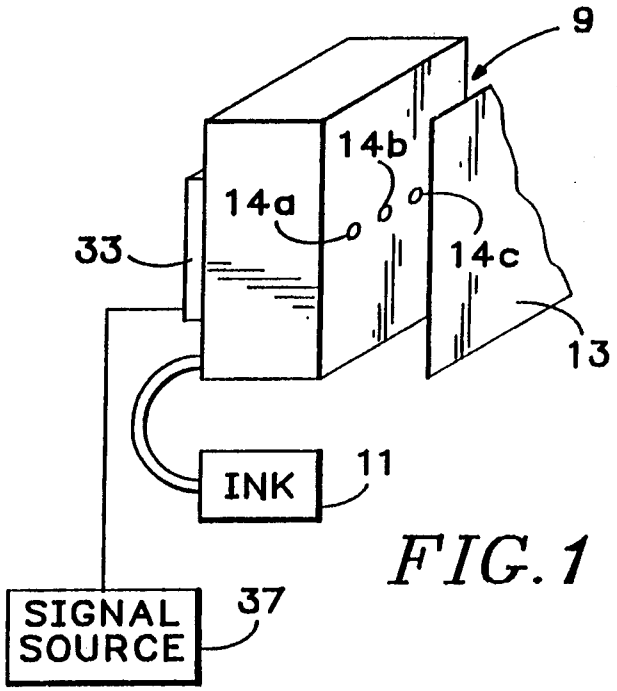
FIG. 1 is a schematic perspective view of an embodiment of an ink jet print head of the present invention, with a print medium shown spaced therefrom.
Figure 3:
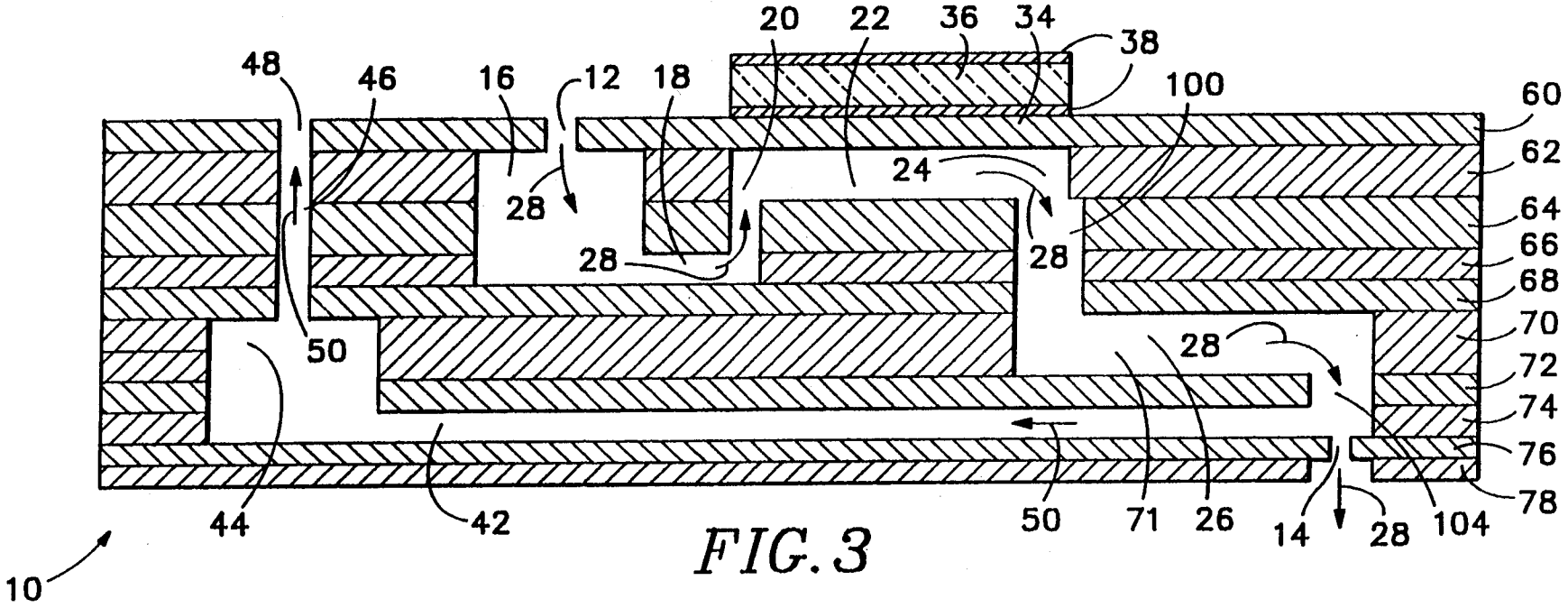
FIG. 3 is a diagrammatic cross-sectional view of an embodiment of an ink jet print head of the present invention.

With reference to FIG. 1, a DOD ink jet print head 9 includes an internal ink pressure chamber (FIG. 3) coupled to or in communication with an ink source 11. Ink jet print head 9 exhibits one or more ink drop ejection orifice outlets or nozzles 14, of which nozzles/outlets **14*a*, 14*b*, and 14*c* are shown, with each nozzle/outlet 14 coupled to or in communication with the ink pressure chamber by way of an ink drop ejecting orifice (FIG. 3). Ink passes through nozzle/outlet 14 during ink drop formation. Ink drops travel in a direction along a path from nozzles/outlets 14 toward a print medium 13, which is spaced from nozzles/outlets 14. A typical ink jet printer includes a plurality of ink pressure chambers each coupled to one or more nozzles/outlets 14**.

An acoustic drive mechanism 33 is utilized for generating a pressure wave or pulse, which is applied to the ink residing within an ink pressure chamber to cause the ink to pass outwardly through an associated nozzle/outlet 14. Acoustic driver 33 operates in response to signals from a signal source 37 to cause pressure wave application to the ink.

Figure 2:
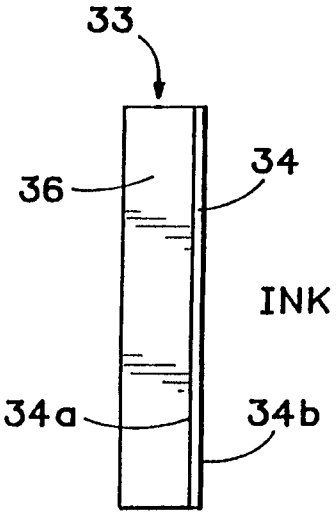
FIG. 2 is a schematic side view of an embodiment of an acoustic driver component of the ink jet print head of the present invention oriented as in FIG. 1.

FIG. 2 schematically illustrates an embodiment of drive mechanism 33 of the present invention, including a piezoelectric ceramic portion 36 and an individual diaphragm 34. Diaphragm 34 is operably connected to piezoelectric ceramic 36 along a surface 34*a* and contacts ink contained in an ink pressure chamber (FIG. 3) along a surface 34*b*. Surface 34*b* is electropolished to provide an improved drive mechanism 33 incorporated in ink jet print heads of the present invention. While the adjacent surface areas of piezoelectric ceramic 36 and diaphragm 34 are depicted in FIG. 2 as the same, this need not be the case. As can be clearly seen from FIG. 3, a plurality of individual diaphragms 34 may be formed in a diaphragm plate 60. In such a configuration, each piezoelectric ceramic 36 is centered over an ink pressure chamber 22, and the portion of diaphragm plate 60 that contacts ink contained in pressure chamber 22 is electropolished in accordance with the present invention.

Piezoelectric ceramic portions 36 may be of any composition and construction capable of deformation in response to input from voltage source 37. In addition, each piezoelectric ceramic 36 is operably connectable to each diaphragm 34 portion of diaphragm plate 60, such that the diaphragms 34 deflect as piezoelectric ceramics 36 deform. One method of achieving a piezoelectric ceramic 36/diaphragm 34 operable connection is through the application of epoxy at locations along the piezoelectric ceramic 36/diaphragm surface 34a interface. For example, the epoxy is applied to one or the other of the piezoelectric ceramic or the diaphragm and then doctor-bladed to a uniform thickness. More specifically, a blade is passed over the surface having epoxy applied thereto at a constant height above the surface. Contact of the blade with the epoxy causes the epoxy to be spread to a uniform thickness. Other conventional affixation agents and techniques may alternatively be employed for this purpose.

Piezoelectric ceramic portions of a variety of shapes may be employed, such as circular, rectangular, hexagonal or otherwise polygonal shape of substantially equal diametrical dimensions and the like. In addition, each piezoelectric ceramic portion employed in the practice of the present invention may operate through various modes of deflection, such as bending and longitudinal modes. Hexagonal and circular piezoelectric ceramics operating in bending mode are preferred, with the hexagonal shape more preferred. Piezoelectric ceramics preferably conform to the shape of substantially circular or hexagonal ink pressure chambers 22. A slight increase in drive voltage is required if hexagonal components are employed. Suitable piezoelectric ceramics can therefore be cut from a large slab of material using, for example, a circular saw. The diameter of the inscribed circle of hexagonal piezoelectric ceramics is typically several thousandths of an inch less than the diameter of the associated pressure chamber, while the circumscribed circle of such ceramics is several thousandths of an inch larger. A typical diameter is about 110 mils. Piezoelectric ceramics are typically no more than 10 mils thick, but they may be either thicker or thinner, with from about 6 to about 10 mils preferred.

Piezoelectric ceramic portions useful in the present invention are known and commercially available. Piezoelectric ceramics that achieve a large deflection in response to a small electrical input, i.e., have a high $d_{31}$ coefficient, are preferred. Piezoelectric ceramics are typically purchased as sheets and cut into the desired shape using a Kerfing saw, for example. For example, a piezoelectric ceramic N21 available from Tokin, Japan may be used in practicing the present invention. A practitioner in the art could design or choose as well as implement an appropriate piezoelectric ceramic portion.

Diaphragms 34 may be of any composition and construction capable of bonding to piezoelectric ceramics 36 and deflection in response to such deformation. In addition, diaphragms are constructed to be amenable to electropolishing techniques, exhibiting a decrease in surface defect density as a result thereof. Diaphragms may exhibit a larger surface area than the piezoelectric ceramic to which they bonded and/or than the surface area of the ink pressure chamber 22 for which they provide a wall. For example, a plurality of diaphragms 34 exhibiting substantially the same shape and surface area as the associated piezoelectric ceramics may be formed as a diaphragm plate 60. If so, only those portions of diaphragm plate 60 that contact the ink in the ink pressure chambers need be electropolished in accordance with the present invention. A typical diaphragm diameter is therefore about 110 mils.

Preferably, diaphragms are composed of stainless steel, although other materials meeting the aforementioned criteria, such as nickel, copper, aluminum and the like may also be used. More preferably, diaphragms are stainless steel selectively plated with a braze material such as gold. Also, diaphragms useful in the practice of the present invention may range from about 1 mil to about 10 mils in thickness, with from about 2.5 to about 5 mils preferred. For example, a diaphragm may be composed of a stainless steel sheet of about 4 mil thickness, with each individual diaphragm portion having a surface area of 3.8 inches by 1.3 inches, and plated (on surface 34*b* facing the ink) with about 8 micro inches of gold. The gold is etched off at the ink pressure chamber sites prior to electropolishing. Electropolishing of the portion of diaphragm surface 34*b* that will contact ink during the operation of the ink jet print head of the present invention is carried out to a range from about 1 to about 6 microns, with a range of about 2 microns preferred.

Diaphragm materials that may be electropolished in accordance with the present invention are known and commercially available. Diaphragm material is typically purchased in sheets and is preferably photochemically machined or blanked into the desired shapes. If photochemical machining is employed, as preferred, such machining is conducted prior to gold plating and electropolishing treatments. In contrast, gold plating and electropolishing precede blanking. In this manner, the handling of individual parts is minimized. For example, commercially available 4 mil thick, 12″×24″ stainless steel sheets may be used in preparing diaphragms of the present invention. A practitioner in the art could design as well as implement an appropriate diaphragm structures.

The photochemical machining, gold plating, gold etching and electropolishing as well as photoresist application and removal conducted in processing diaphragms may be accomplished using conventional techniques therefor. In general, a diaphragm sheet is processed as follows to provide a component to be included in assembly of an ink jet print head. After photochemical machining and gold plating, a photoresist layer is applied to the gold-plated stainless steel diaphragm sheet and is developed, such that only the portion(s) of surface 34*b* of the diaphragm sheet that will contact ink upon assembly are exposed. On the 34*a* surface, the entire area where the piezoelectric ceramics will be attached is exposed. The gold plating is etched off at those unprotected portions of diaphragm surfaces 34*a* and 34*b*. Electropolishing of the exposed stainless steel portion of diaphragm sheet surface 34*b* is conducted, preferably in accordance with the procedure outlined below. The photoresist layer is removed, the sheet is cut into 1.3"×3.8" diaphragm layers 60, these layers are cleaned, and ink jet print head 9 of the present invention is assembled, preferably as described below.

An exemplary electropolishing process useful in the practice of the present invention employs conventional electropolishing equipment, including both fixtures and power supply (e.g., Pulser Model No. 100204 available from Pulsco, Inc., Andover, Mass.) and proceeds as set forth below. 2.67 grams of FLUORAD FC 95 available from Minnesota Mining and Manufacturing Co., Minneapolis, Minn. is admixed with 400 ml of concentrated, reagent grade phosphoric acid in a polypropylene bottle. This Fluorad stock solution is then stored until needed in preparation of an electropolishing bath.

An electropolishing bath is prepared by admixing 5 gallons of reagent grade phosphoric acid and 1.2 gallons of reagent grade sulfuric acid. 90 ml of the Fluorad stock solution is added to the acid mixture to achieve an appropriate concentration of FLUORAD FC 95, with a concentration of between about 20 ppm and about 50 ppm FLUORAD FC 95 in the electropolishing bath preferred. The level of FLUORAD FC 95 is preferably checked periodically during electropolishing to be sure that an appropriate level is maintained. Heat is applied to the electropolishing bath to bring the bath temperature to 53±3° C.

Diaphragm plates 60 should be examined to assure that gold has been removed from the area to be electropolished and that the area is substantially free from dents. Also, the electro-polishing equipment should be examined to assure that the negative lead from the power supply is attached to the anode plate of the electropolishing fixture.

To properly electropolish the relevant portion of diaphragm plate 60 surface 34*b*, an appropriate amount of current must be employed for an appropriate amount of time. For example, diaphragm plates may be electropolished in groups of seven. Such a group may be polished by the application of 49 ampere-minutes of current. In other words, about 7 amperes of current applied for 1 minute is required to electropolish each diaphragm plate. Preferably, a group of seven diaphragm plates is polished with a pulse power supply providing a 50 ampere pulse that is on for 9.0 msec, followed by a 10 msec off cycle. The pulse power supply is set to provide 49 ampere-minutes of current.

Diaphragm plates are inserted into a conventional electropolishing fixture and attached to a backing plate component of the fixture by any convenient means such as an alligator clip. Other conventional fastening means may be alternatively employed for this purpose. Preferably, diaphragm plates abut the backing plate along the entire length of the diaphragm. At this time, the orientation of the diaphragm plate is such that surface 34*b* is facing the anode, and surface 34*a* abuts the backing plate. The anode and diaphragm plate/backing plate are completely submerged in the electropolishing bath. The electropolishing current is applied to the exposed portion(s) of diaphragm plate surface 34*b* for the electropolishing time as discussed above.

After current application, the diaphragm plate is removed from the electropolishing bath and is dipped in and stirred within one or more, preferably two, rinse tanks filled with de-ionized (DI) water. After rinsing, the diaphragm plate is preferably carefully sprayed with a DI water spritzer. In this manner, residual acid from the electropolishing bath is removed from the diaphragm plate. Preferably, the diaphragm is then carefully blow dried.

Any other electropolishing or diaphragm plate treatment process may be employed in the practice of the present invention. When considered together, such alternative processes should achieve the same or similar reduction in surface nucleation site density. A practitioner in the art would be able to design as well as implement appropriate electro-polishing and diaphragm plate treatment procedures.

The invention has particular applicability and benefits when piezoelectric ceramic 36/diaphragm 34 drive mechanisms 33 are used in ink drop formation. One preferred form of an ink jet print head using this type of acoustic driver is described in detail in U.S. Pat. No. 5,087,930, entitled "Drop-on-Demand Ink Jet Print Head". Other forms of ink jet printers and acoustic drivers may be used in conjunction with the present invention. For example, longitudinal mode piezoelectric ceramic drivers may be used, so long as the ink-contacting portion(s) of driver-associated components are processed in accordance with the present invention.

An embodiment of a single ink jet in ink jet print head 9, as described in the above-identified U.S. Pat. No. 5,087,930 now U.S. Pat. No. 5,087,930, is shown in FIG. 3. This ink jet has a body 10 which defines an ink inlet 12 through which ink is delivered to ink jet print head 9. Body 10 also defines an orifice outlet or nozzle 14 together with an ink flow path 28 from ink inlet 12 to nozzle/outlet 14. In general, ink jet print head preferably includes an array of nozzles/outlets which are proximately disposed, that is closely spaced from one another, for use in printing drops of ink onto a print medium (FIG. 1).

To facilitate manufacture of ink jet print head 9 in accordance with the present invention, body 10 is preferably formed of plural laminated plates or sheets, such as of stainless steel. These sheets are stacked in a superposed relationship. In the embodiment illustrated in FIG. 3, these sheets or plates include a diaphragm plate 60, which forms diaphragm 34 and also defines ink inlet 12 and a purging outlet 48; an ink pressure chamber plate 62, which defines an ink pressure chamber 22, a portion of an ink supply manifold 16, and a portion of a purging passage 46; a separator plate 64, which defines a portion of an ink passage 26, bounds one side of pressure chamber 22 defines an inlet 20 and an outlet 24 to pressure chamber 22, defines a portion of supply manifold 16 and also defines a portion of purging passage 46; an ink inlet plate 66, which defines a portion of passage 26, an inlet channel 18, and a portion of purging passage 46; another separator plate 68, which defines portions of passages 26 and 46; an offset channel plate 70, which defines a major or offset portion 71 of passage 26 and a portion of a purging manifold 44; a separator plate 72, which defines portions of passage 26 and purging manifold 44; an optional outlet plate 74, which defines a purging channel 42 and a portion of purging manifold 44; a nozzle plate 76, which defines nozzles/outlets 14 of the array; and an optional guard plate 78, which reinforces nozzle plate 76 and minimizes the possibility of scratching or other damage to nozzle plate 76.

More or fewer plates than illustrated may be used to define the various ink flow passageways, manifolds and pressure chambers of ink jet print head 9. For example, multiple plates may be used to define ink pressure chamber 22 instead of the single plate illustrated in FIG. 3. Also, not all of the various features need be in separate sheets or layers of metal. For example, patterns in the photoresist that are used as templates for chemically etching the metal. (if chemical etching is used in manufacturing) could be different on each side of a metal sheet. More specifically, the pattern for the ink inlet passage could be on one side of the metal sheet while the pattern for the pressure chamber could be on the other side and in registration front-to-back, for example. With carefully controlled etching, separate ink inlet passage and pressure chamber containing layers could therefore be combined into one common layer.

To minimize fabrication costs, all of the metal layers of ink jet print head 9, except diaphragm plate 60 and nozzle plate 76, are designed so that they may be fabricated using relatively inexpensive conventional photo-patterning and etching processes in metal sheet stock. Machining or other metal working processes, such as the electro-polishing process required for diaphragms 34 of diaphragm plate 60, are not required.

Nozzle plate 76 has been made successfully using any number of varying processes, including electroforming from a sulfumate nickel bath, microelectric discharge machining in three hundred series stainless steel, and punching three hundred series stainless steel, the last two approaches being used in concert with photo-patterning and etching all of the features of nozzle plate 76 except nozzles/outlets 14 themselves. Another suitable approach is to punch nozzles/outlets 14 and to use a standard blanking process to form the rest of the features in plate 76.

Ink jet print head 9 is designed so that layer-to-layer alignment is not critical. That is, typical tolerances that can be held in a chemical etching process are adequate in the fabrication of the print heads.

The various layers forming ink jet print head 9 may be aligned and bonded in any suitable manner, including by the use of appropriate mechanical fasteners. However, a preferred approach for bonding the metal layers is described in U.S. Pat. No. 4,883,219 entitled "Manufacture of Ink Jet Print Heads by Diffusion Bonding and Brazing, " now U.S. Pat. No. 4.883,219. This patent is incorporated herein in its entirety by reference.

In accordance with one approach described in this referenced patent application, the various metal layers are plated with a layer of from one-eighth to one-quarter micron thick metal that diffusion bonds well to itself; that is also a good brazing material; and that can be reliably plated onto the stainless steel layers of the ink jet print head, or to other materials forming the ink jet print head in the event stainless steel is not used. Gold, for example, can be plated readily onto stainless steel and bonds and brazes particularly well. After plating, the various layers are stacked in sequence on a simple two-pin alignment fixture that also may serve as a platen of the diffusion bonding fixture. The stacks of parts are (a) diffusion bonded at 400°-525° C., preferably between 500°-525° C., a temperature range which minimizes thermal distortions in the various layers; (b) removed from the diffusion bonding fixtures; (c) inserted without fixing into a hydrogen-atmosphere brazing furnace; and (d) brazed.

This bonding process is hermetic, produces high strength bonds between the parts, leaves no visible fillets to plug the small channels in the print head, does not distort the features of the print head, and yields an extremely high percentage of satisfactory print heads, approaching one hundred percent. This manufacturing process can be implemented with standard plating equipment, standard furnaces, and simple diffusion bonding fixtures, and can take less than three hours from start to finish for the complete bonding cycle, with many ink jet print heads being simultaneously manufactured. In addition, the plated metal is so thin that essentially all of it diffuses into the stainless steel during the brazing step so that none of it is left to interact with the ink, either to be attacked chemically or by electrolysis. Therefore, plating materials, such as copper, which are readily attacked by some inks may be used in this bonding process.

Ink entering ink inlet. 12, e.g., from ink supply 11 (FIG. 1), passes to an ink supply manifold 16. A typical color ink jet print head has at least four such manifolds for receiving, respectively, black, cyan, magenta, and yellow ink for use in black plus three color subtraction printing. The number of ink supply manifolds may be varied depending upon whether a printer is designed to print solely in black ink, with less than a full range of color, or with one or more additional colors deposited directly rather than formed subtractively from cyan, magenta and yellow. From ink supply manifold 16, ink flows through an ink inlet channel 18, through an ink inlet 20 and into an ink pressure chamber 22. Ink exits ink pressure chamber 22 by way of an ink pressure chamber outlet 24. Ink then flows through an ink passage 26 to nozzle 14 from which ink drops are ejected. A series of arrows 28 diagram this ink flow path.

Ink pressure chamber 22 is bounded on one side by diaphragm 34, electropolished in accordance with the present invention. Piezoelectric ceramic portion 36 secured to diaphragm 34 through the use of epoxy overlays ink pressure chamber 22. Conventionally, piezoelectric ceramic 36 has at least one metal film layer 38 to which an electronic circuit driver (voltage source 37 in FIG. 1) is electrically connected. Preferably as shown in FIG. 3, piezoelectric ceramic 36 has a metal film layer 38 disposed on two opposed surfaces thereof disposed in the plane of the metal layers forming the ink jet print head. Although other forms of piezoelectric ceramics may be used, ceramic 36 shown in FIG. 3 is operated in bending mode. Specifically, when a voltage is applied across piezoelectric ceramic 36, ceramic 36 attempts to change its dimensions. Because piezoelectric ceramic 36 is securely and rigidly attached to diaphragm 34, bending occurs. Such bending displaces ink located in ink pressure chamber 22, causing the flow of ink through ink passage 26 to nozzle/outlet 14. Refill of ink pressure chamber 22 following the ejection of an ink drop can be augmented by reverse bending of piezoelectric ceramic 36 signaled by the electric circuit driver (voltage source 37 in FIG. 1).

For efficiency reasons, pressure chambers 22 having a transverse cross-sectional dimension that is substantially equal in all directions are preferred. Consequently, pressure chambers of, for example, hexagonal or circular cross-section are preferred.

Figure 4A:
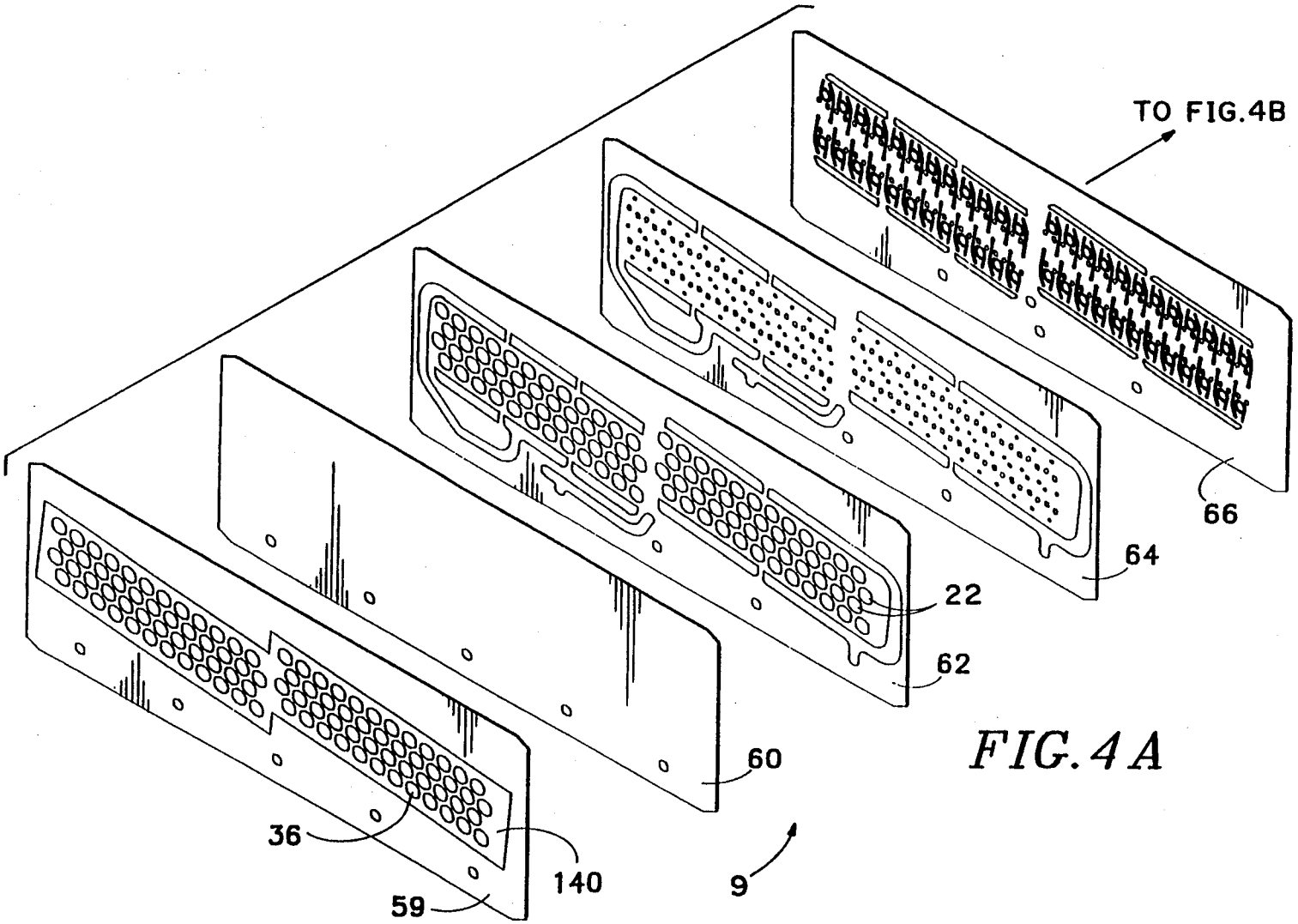
FIG. 4 is an exploded perspective view of the various layers of an ink jet print head array in accordance with an embodiment of the present invention employing ninety-six nozzles in the array.
Figure 4B:
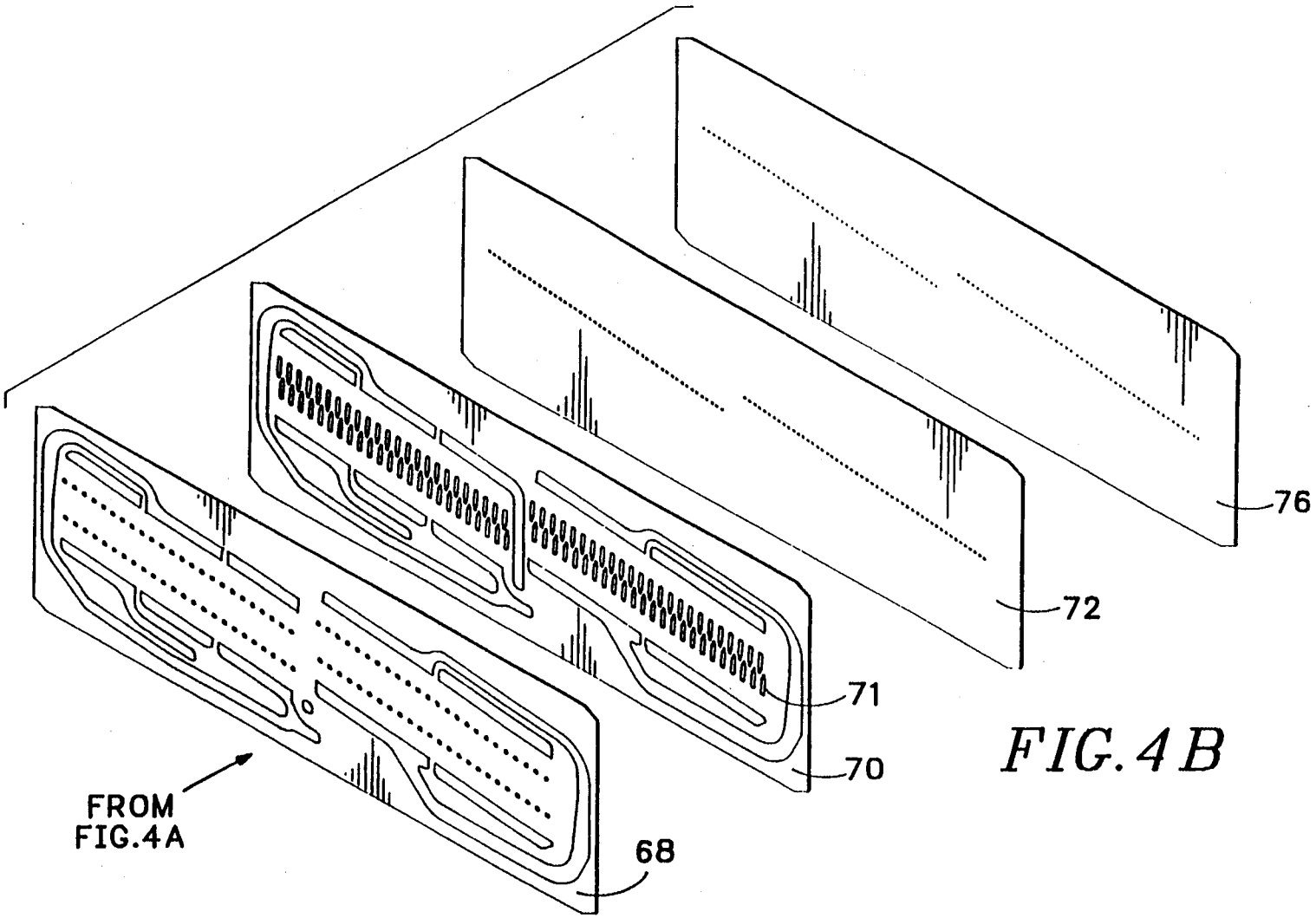

To provide an extremely compact and easily manufactured ink jet print head, the various pressure chambers 22 of an ink jet print head are generally arranged in a substantially planar manner, as shown in FIG. 4. Pressure chambers are therefore much larger in transverse cross-sectional dimension than in depth, which results in a higher pressure for a given displacement of acoustic driver 33 into the volume of the pressure chamber. Moreover, all ink jet pressure chambers off a preferred ink jet print head are located in the same plane or at the same depth within the ink jet print head. This plane corresponds to the plane of one or more plates 62 (FIGS. 3 and 4) which define those pressure chambers.

In order to achieve an extremely high packing density, the pressure chambers 22 are preferably arranged in at least two parallel rows with their geometric centers offset or staggered from one another. Also, the pressure chambers are typically separated by very little sheet material. In general, only enough sheet material remains between the pressure chambers as is required to accomplish reliable (leak-free) bonding of the ink pressure chamber defining layers to adjacent layers.

As shown in FIG. 3, ink passages 26 are provided to connect each pressure chamber 22 to its associated nozzle/outlet 14. In general, each of these passages 26 is composed of a first section 91 extending in a direction normal to the pressure chamber for a first distance, a second offset channel section 71 extending in a second direction parallel to the plane of the pressure chamber for a second distance, and a third section 93 extending normal to the second direction and to the nozzle/outlet 14. Offset channel portion 71 enables the alignment of nozzles in one or more rows (FIGS. 4, 7 and 13) with the center-to-center spacing of the nozzles being much closer together than the center-to-center spacing of the associated pressure chambers.

Offset channel sections 71 comprise a major portion of passages 26. In addition, passages 26, and in particular the offset channel portions thereof, are located in ink jet print head layers between pressure chambers 22 and nozzles/outlets 14. Preferably, passages 26 are of the same cross-sectional dimension and length. If inlet channels 18 to the pressure chambers 22 are also of similar cross-sectional dimension and length, all of the jets in a preferred ink jet print head have the same resonance characteristics and can therefore be driven with identical wave forms to provide substantially identical ink drop jetting characteristics from the various nozzles/outlets. Furthermore, offset channel portions are typically positioned in a single common plane so as to minimize the thickness and thus the weight and cost of the ink jet print head.

When the center-to-center spacing of hexagonally arranged pressure chambers 22 is 0.135 inch, the distance from the center of the radius at one end of offset channel sections 71 to the center of the radius at the other end is 0.116 inch. That is, from the geometry of an equilateral triangle, offset channel length is equal to ink pressure chamber center-to-center spacing multiplied by ($\sqrt{3}/2$). In addition, offset channels are typically 0.015 inch wide at the end adjacent to the nozzle/outlet and 0.024 inch wide at the other end (adjacent to the pressure chamber), although the widths may be varied. For example, widths at the end adjacent the pressure chamber ranging from 0.020 to 0.036 inch have been successfully tested. A typical offset channel thickness is 0.20 inch and may be achieved, for example, by superimposing two identical layers, rather than by the single layer construction shown in FIG. 3.

With further reference to FIG. 3, ink supply channels 18 are defined by a plate 66 located in a plane between ink pressure chambers 22 and nozzles/outlets 14. In an ink jet print head construction having a plurality of rows of pressure chambers, it is preferable to eliminate the need for ink supplied to the inner rows of pressure chambers to pass between the pressure chambers of the outer rows, which increases the required spacing between pressure chambers. To accomplish this goal, ink is supplied to pressure chambers from a plane located beneath the pressure chambers. That is, ink flows from the exterior of the ink jet print head to a location in a plane between the pressure chambers and the nozzles/outlets. Ink supply channels then extend to locations in alignment with the respective pressure chambers and are coupled thereto from the underside of the pressure chambers.

To provide fluid impedance of ink supply channels to inner rows of pressure chambers that is the same as the fluid impedance of the channels to the outer rows of pressure chambers, the channels are configured to have the same cross section and same overall length. The length of the channels, and their cross sectional area determine their characteristic impedance, which is chosen to provide the desired performance of the individual ink jets disposed in the array and to avoid the use of small orifices or nozzles at inlets 20 to the pressure chambers. Typical channel dimensions are 0.275 inch long by 0.010 inch wide and vary from 0.004 inch thick to 0.016 inch thick, depending upon the viscosity of the ink. Ink viscosity typically varies from about one centipoise for aqueous inks to about ten to fifteen centipoise for hot melt inks. The important factor is to size channels so as to supply sufficient ink for operation at the desired maximum ink jet printing rate while still providing satisfactory acoustic isolation of the ink pressure chambers.

Inlet and outlet manifolds 16, 44 are preferably situated outside of the boundaries of the rows of pressure chambers 22. In addition, the cross sectional dimensions of the inlet and outlet manifolds are optimized to contain the smallest volume of ink and yet supply sufficient ink to nozzles/outlets 14 when all such nozzles/outlets are simultaneously operating and to provide sufficient compliance to minimize nozzle-to-nozzle interactions. Typical cross sectional dimensions are 0.12 by 0.02 inch. If outlet channels 42 and outlet manifolds 44 are eliminated, as is preferred, inlet manifolds 16 may be placed between outer rows of pressure chambers and nozzles/outlets in the same layer as offset channels 71. Advantages to this construction are that the ink jet print head may be more compact and that inlet channels to both the inner and outer rows of pressure chambers may exhibit the same configuration and yet be of the same cross section and length. When outlet channels 42 are omitted, layer 72 is preferably retained to provide additional support to nozzle layer 76. When inlet manifolds are placed entirely beneath the outer rows of pressure chambers, more rows of pressure chambers 22 can be placed on an extension of the same hexagonal grid. In other words, a greater number of pressure chambers may be included in layer 62.

Although plural ink supply channels 18 are supplied with ink from each manifold 16, acoustic isolation between the pressure chambers 22 coupled to a common manifold is achieved. More specifically, ink supply manifolds and ink supply channels function, in effect, as acoustic R-C circuits to dampen pressure pulses. These pressure pulses otherwise could travel back through the supply channels from the pressure chambers in which they were originated, pass into the common manifold, and then into adjacent supply channels and adversely affect the performance of adjacent nozzles/outlets. In this configuration, manifolds provide compliance and inlet channels provide acoustic resistance, such that pressure chambers are acoustically isolated from one another. By acoustic isolation it is meant that the effect on the ink drop ejection characteristics of one nozzle/-outlet, resulting from the operation of any other nozzle(s)/outlet(s) connected to the same manifold, has been observed to be no greater than ten microseconds and typically no more than three microseconds over the entire range of drop ejection rates. This amount of cross-talk has no visible effect on the resulting print.

Nozzles/outlets 14 have a central axis which is generally normal to the plane of plate 62 and thus to the plane of the ink pressure chambers 22 associated with the nozzles/outlets. In addition, the central axes of the nozzles/outlets, if extended to intersect plate 62, are offset from and do not intersect the associated pressure chambers. In the layers of ink jet print head 9 shown in FIGS. 7 and 13, the nozzles/outlets are arranged in two rows, which preferably (but not necessarily) are substantially straight line rows offset from horizontal. Pressure chambers coupled to each row of nozzles/outlets are arranged in four rows.

As discussed above, a typical transverse dimension of pressure chambers 22 is 0.110 inch, with the hexagonal array of pressure chambers being set with an 0.135 inch center-to-center spacing. As a result, pressure chambers are closely spaced with only a minimal amount of plate material between them necessary for bonding purposes. Nozzle/outlet 14 diameters ranging from 35 to 85 microns have been used successfully, although useful nozzle/outlet dimensions are not limited to this range. For printing with aqueous based inks at 300 dots per inch, a preferred nozzle/outlet diameter is about 40 microns. For printing with hot melt or phase change inks at 300 dots per inch, because of the limited spreading of the ink drops on the print medium, a preferred nozzle/outlet diameter is about 75 microns. In both of these instances, a preferred thickness of nozzle plate 76 is about 63 to 75 microns or 0.0025 to 0.0030 inch.

Moreover, the center-to-center spacing of nozzles/-outlets 14 during operation is about 0.0335 inch. At this spacing, if a line of nozzles/outlets is rotated from horizontal through an angle whose arctangent is 1/10 (FIG. 4), the vertical distance between adjacent nozzles/outlets is 1/300 inch and the corresponding horizontal spacing is 10/300 inch. At these horizontal and vertical spacings, ink jet print head 9 is set to print at an addressability of 300 dots per inch in both the horizontal and vertical directions.

Figure 16:
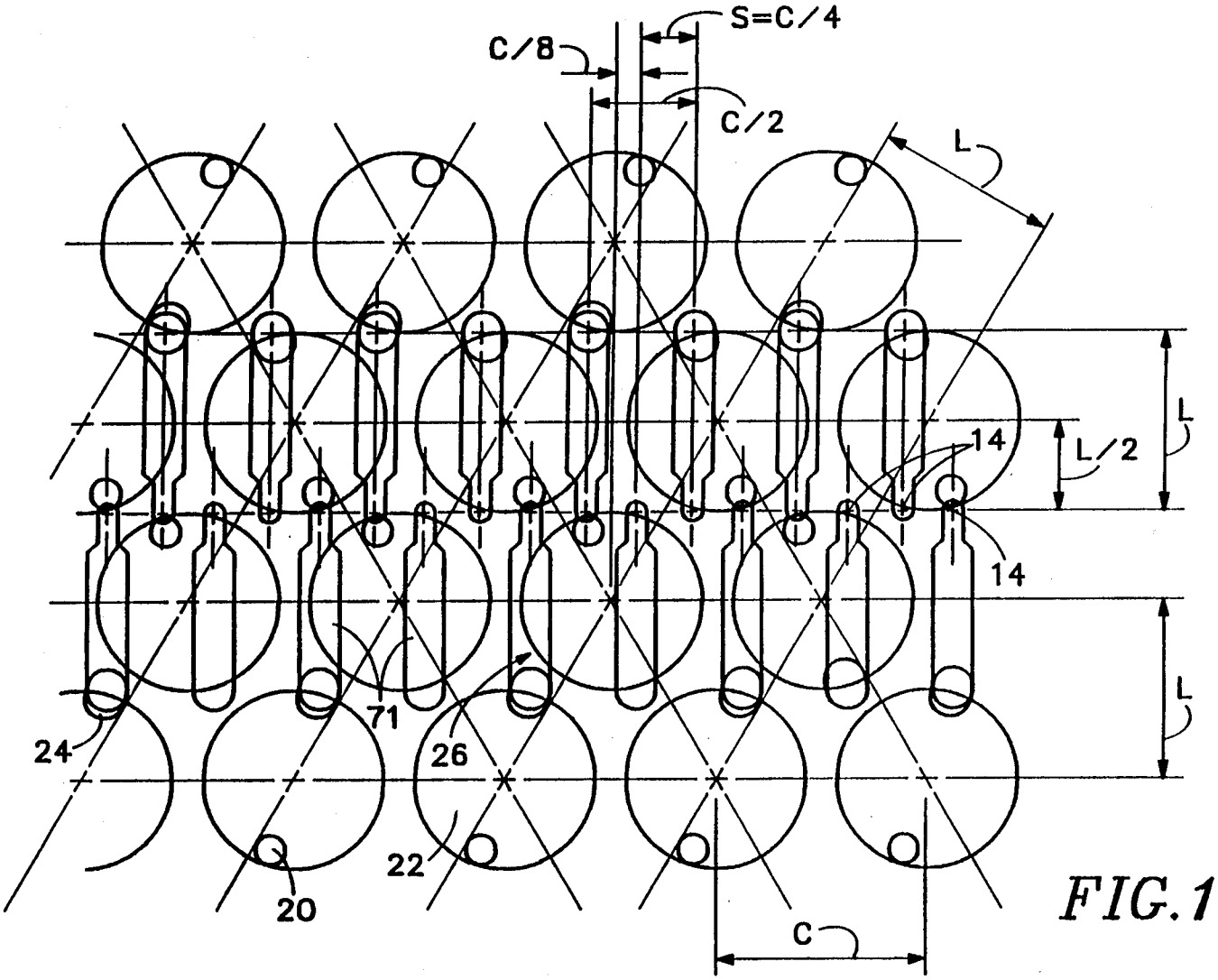
FIG. 16 is a schematic illustration of overlayed ink pressure chambers, ink inlet and outlet passageways and offset channels of an ink jet print head, illustrating the preferred transverse spacing of inlet and outlet openings and the orientation of the nozzles with respect to the ink pressure chambers.

If the geometrical arrangement of pressure chambers 22 and nozzles/outlets 14 is as described above and the inverse vertical addressability is v; the inverse horizontal addressability is h; and the number of horizontal addresses between nozzles is n, the spacing s, between nozzles, the center-to-center spacing C between pressure chambers and the distance L between rows of pressure chambers shown in FIG. 16 are expressed by the following relationships:

$$s=\sqrt{v^2+(nh)^2}$$

$$C=4s=4\sqrt{v^2+(nh)^2}$$

$$L=(\sqrt{3}/2)C=2\sqrt{3}(\sqrt{v^2+(nh)^2})$$

FIG. 16 illustrates a preferred arrangement wherein ink inlets 20 to pressure chambers 22 and ink outlets 24 from those pressure chambers are diametrically opposed. These diametrically opposed inlets and outlets provide cross flushing of the pressure chambers during filling and purging to facilitate the sweeping of bubbles and contaminants from the pressure chambers. This arrangement also provides the largest distance between pressure chamber inlets and outlets for enhanced acoustic isolation. In addition, the pressure chamber outlets are closer in the fluid path, that is, fluidically closer, to nozzles/outlets 14 than the pressure chamber inlets.

In the FIG. 16 configuration, nozzles/outlets 14 may be arranged with center-to-center spacings which are much closer than the center-to-center spacings of closely spaced and associated pressure chambers 22. For example, assuming the center-to-center spacing of the pressure chambers is X, the center-to-center spacing of the associated nozzles/outlets is preferably one-fourth X. For purposes of symmetry, it is preferable that the nozzle-to-nozzle spacing in a row of nozzles/outlets is the inverse of the number of rows of ink pressure chambers supplying the row of nozzles/outlets. For example, if there were six rows of ink pressure chambers supplying one row of nozzles/outlets, the nozzle-to-nozzle spacing would preferably be one-sixth of the center-to-center spacing of these ink pressure chambers. Consequently, an extremely compact ink jet print head is provided with closely spaced nozzles/outlets. As a specific example of the compact nature of ink jet print heads 9, the 96 nozzle array jet of FIG. 4 is about 3.8 inches long by 1.3 inch wide by 0.07 inch thick.

In addition to ink flow path 28 described above, an optional ink outlet or purging channel 42 is also defined by body 10 of ink jet print head 9. The use of a purging channel is not preferred in the practice of the present invention, however. Purging channel 42 is coupled to ink passage 26 at a location adjacent to, but interior to, nozzle 14. Purging channel 42 extends from ink passage 26 to an outlet or purging manifold 44 which is connected by a purging outlet passage 46 to a purging outlet port 48. Purging manifold 44 is typically connected by similar purging channels 42 to similar ink passages 26 associated with multiple nozzles 14. During a purging operation, ink flows in a direction indicated by a series of arrows 50, through purging channel 42, purging manifold 44, purging outlet passage 46 and to purging outlet port 48.

Ink jet print head 9, as shown in FIG. 4, constitutes a preferred embodiment of the present invention, with elements other than the improved acoustic driver for pressure wave generation having been discussed in the aforementioned U.S. Pat. No. 5,087,930. The illustrated print head has been used on a typewriter-like shuttle printing mechanism to make full color prints at an addressability of 300 dots per inch both horizontally and vertically. This print head has been operated consistently and reliably at all repetition rates up to about 11,000 drops per second per nozzle with the outer limits of operation yet to be determined. The FIG. 4 ink jet print head includes a row of 48 nozzles/outlets that are used to print black ink. This ink jet print head also has a separate, horizontally offset, row of 48 nozzles/outlets that are used to print colored ink. Sixteen of these latter nozzles/outlets are used for cyan ink, sixteen for magenta ink, and sixteen for yellow ink.

The ink jet print head configuration of FIG. 4 can be readily modified to have nozzles/outlets disposed along a single line rather than a dual line. None of the operating characteristics of the ink jet print head would be affected by this modification.

FIGS. 5 through 13 respectively illustrate an acoustic driver receiving spacer plate 59, diaphragm plate 60, ink pressure chamber plate 62, separator plate 64, ink inlet plate 66, separator plate 68, offset channel defining plate 70, separator plate 72 and, nozzle or orifice plate 76 for the 96 nozzle ink jet print head of FIG. 4. This embodiment of ink jet print head 9 is designed with multiple ink receiving manifolds which are capable of receiving various colors of ink. The illustrated embodiment has five sets of manifolds, each set including two manifold sections. The manifold sets are isolated from one another such that the ink jet print head can receive five distinct colors of ink. Ink jet print head 9 of this embodiment can therefore receive cyan, yellow and magenta inks for use in full subtractive color printing together with black ink for printing text. A fifth color of ink could also be used instead of obtaining this fifth color by combining cyan, yellow and magenta inks on the print medium. Also, because black ink is typically used to a greater extent than colored ink in applications in which both text and graphics are being printed, more than one set of manifolds may be supplied with black ink. This latter application is the specific example that is described below.

In addition, by including plural manifold sections for each color of ink, the distance between individual manifold sections and a nozzle/outlet supplied by the manifold section is minimized. This decreased ink travel distance, in turn, minimizes dynamic ink pressure arising from accelerating and decelerating quantities of ink as an ink jet print head shuttles, for example, along a horizontal line during printing.

To more clearly elucidate the nature of the structure shown in FIG. 4, ink flow paths through the various layers of the ink jet print head are discussed with reference to FIGS. 5–13. Throughout the following description, the letter c will be used in conjunction with cyan ink flow path components; the letter y will be used in conjunction with yellow ink flow path components; the letter m will be used in conjunction with magenta ink flow path components; the designation $b_1$ will be used in conjunction with flow path components supplied through the first black ink inlet; and the designation $b_2$ will be used in conjunction with flow path components supplied through the second black ink inlet.

Figure 5:
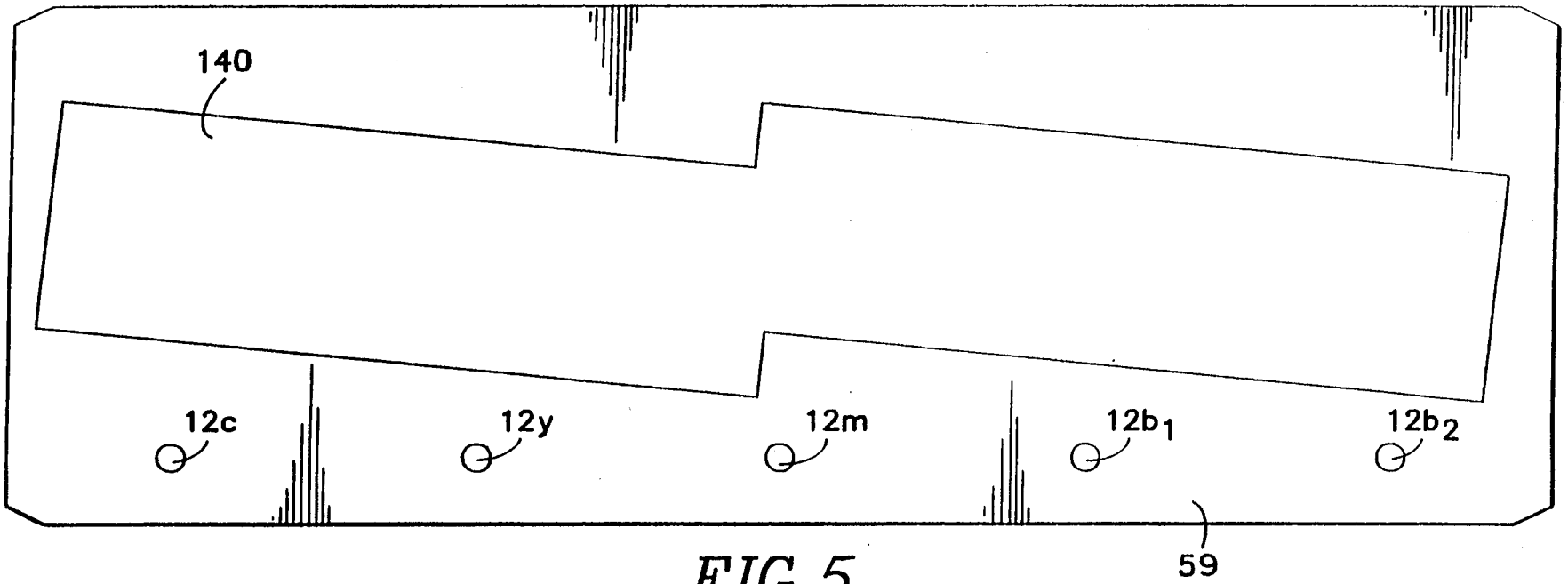
FIGS. 5–13 are top plan views of various layers forming an array ink jet print head of FIG. 4, with the components depicted at about 2.5 times actual size.

With reference to FIG. 5, a spacer plate 59 is shown with an opening 140 within which the piezoelectric ceramics 36 (FIG. 4) are positioned. Spacer plate 59 is optional and provides a flat surface at the rear of the ink jet print head that is co-planar with the outer surface of the piezoelectric ceramics. Plural ink supply inlets are provided through layer 59 through which ink is delivered to the ink jet print head. These inlets are designated 12*c*, 12*y*, 12*m*, 12*b*$_1$, and 12*b*$_2$.

The colors need not be delivered to the ink jet print head in the recited order. As explained below, however, the illustrated ink jet print head has 48 nozzles for printing colored ink at the left-hand and 48 nozzles for printing black ink at the right-hand portion thereof (FIG. 4).

Figure 6:
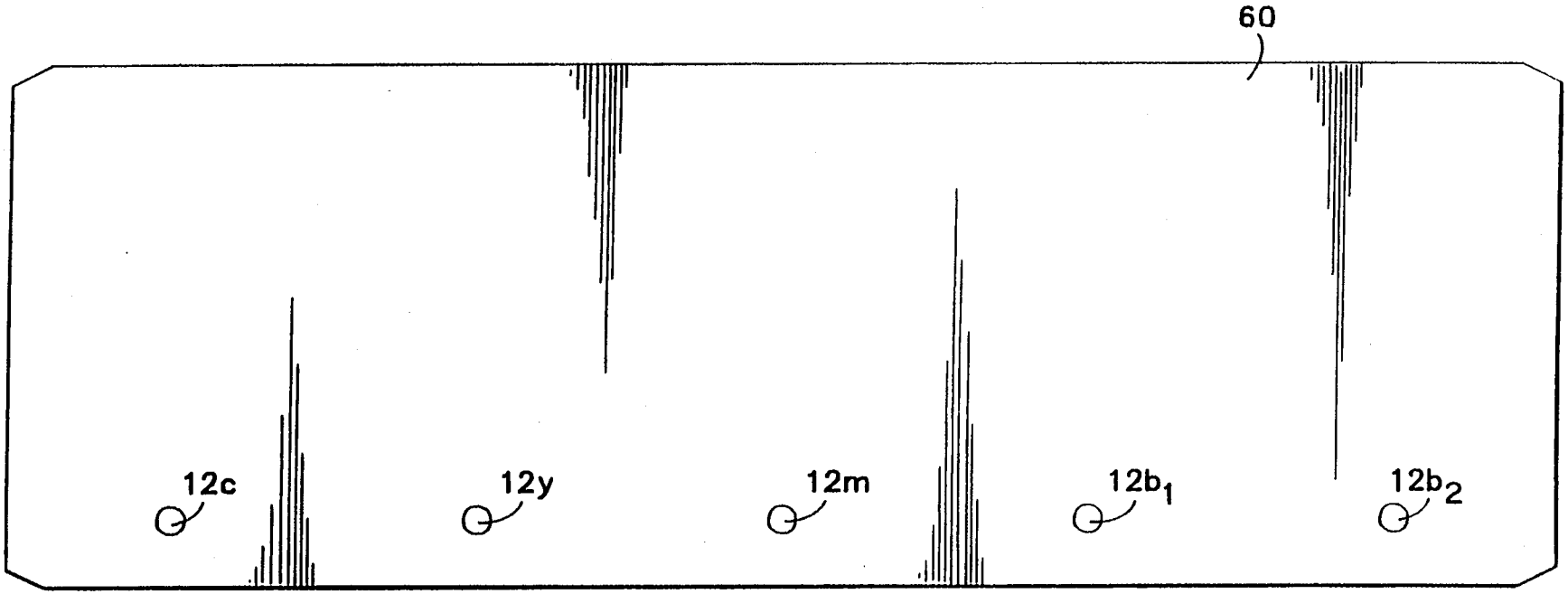

Referring to diaphragm layer 60 in FIG. 6, the respective ink inlets 12*c* through 12*b*$_2$ also extend through this layer.

Figure 7:
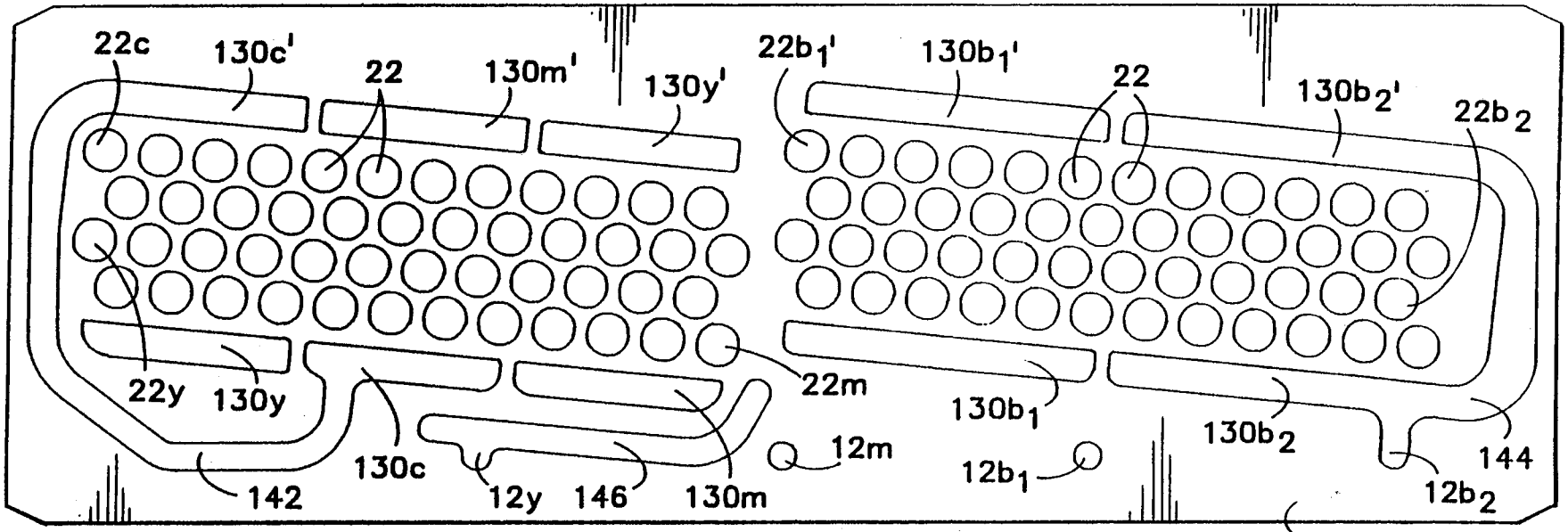

FIG. 7 shows the array of ink pressure chambers 22 employed in this embodiment of ink jet print head 9. Cyan inlet 12*c* is coupled to a cyan ink supply channel 142 in this layer that communicates with two cyan manifold sections 130*c*, 130*c*'. Manifold section 130*c* is located outside of the left-hand array of pressure chambers 22 and adjacent to the lower middle portion of that array. Manifold section 130*c*' is located adjacent to the upper left-hand portion of this pressure chamber array. Also in layer 62, ink inlet 12*b*$_2$ communicates with a channel 144 coupled to respective black ink manifold sections 130*b*$_2$ and 130*b*$_2$'. Manifold section 130*b*$_2$ is located adjacent to the lower right-hand portion of the right-most array of ink jet pressure chambers 22, and the manifold section 130*b*$_2$ is located along the upper right-hand section of that pressure chamber array.

Yellow ink inlet 12*y* is also connected to a communication channel 146 in layer 62, although the coupling of yellow ink inlet 12*y* to yellow ink manifold section 130*y* and 130*y*' (FIG. 7) takes place in another layer. Also, magenta ink supply inlet 12*m* and first black ink supply inlet 12*b*$_1$ pass through layer 62. Inlets 12*m* and 12*b*$_1$ are coupled to respective magenta and black ink manifolds, portions of which are shown as 130*m*, 130*m*', 130*b*$_1$ and 130*b*$_1$' in FIG. 8, in other layers of the ink jet print head. By including communication channels, such as 142, 144 and 146, between separated manifold sections, only five (rather than ten) ink supply ports are required. In addition, by including the manifolds in more than one layer, the depth and, thus, the volume of the manifolds is increased, thereby increasing manifold acoustic compliance.

Figure 8:
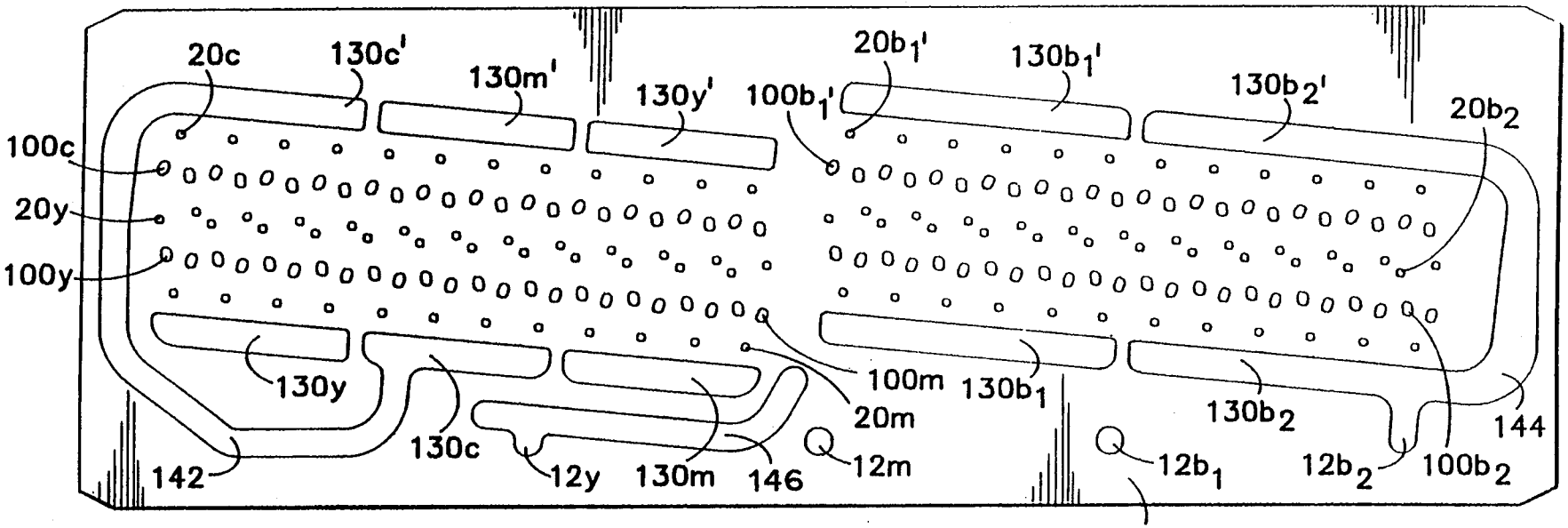
Figure 9:
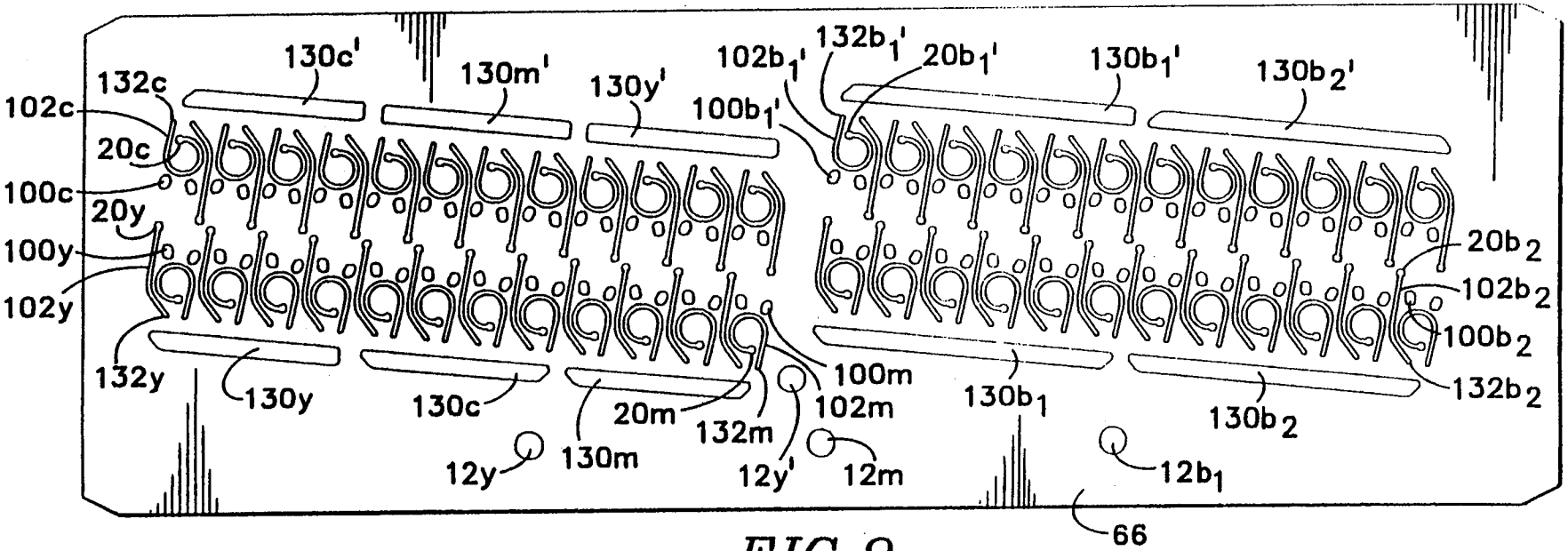

As can be seen from FIG. 8, the manifolds and communication channels of layer 62 are aligned with similar manifolds and communication channels of layer 64. Similarly, with reference to FIG. 9 and layer 66, portions of the ink supply manifolds are included in this layer for added acoustic compliance. Also, layer 66 identifies passageways 12*g* and 12*y*'. These passageways communicate with the ends of communication channel 146 in layers 62 and 64. Also, for added volume and acoustic compliance, portions of the respective manifolds are defined by layer 66.

Figure 10:
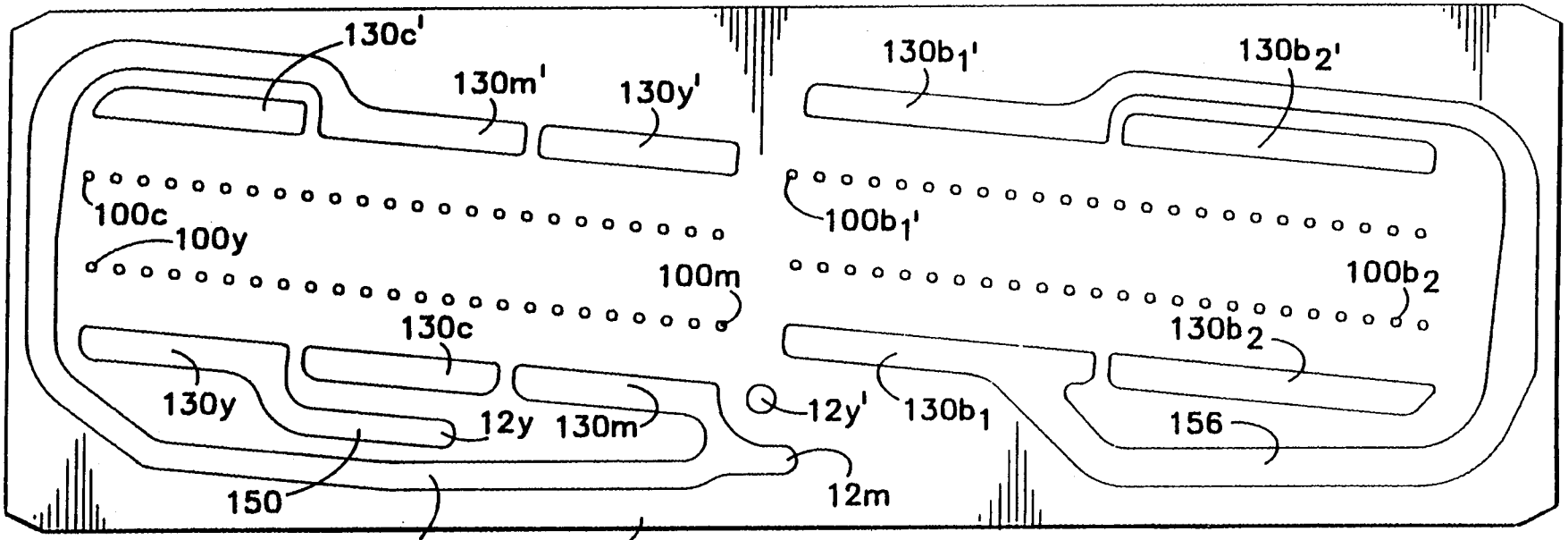
Figure 11:
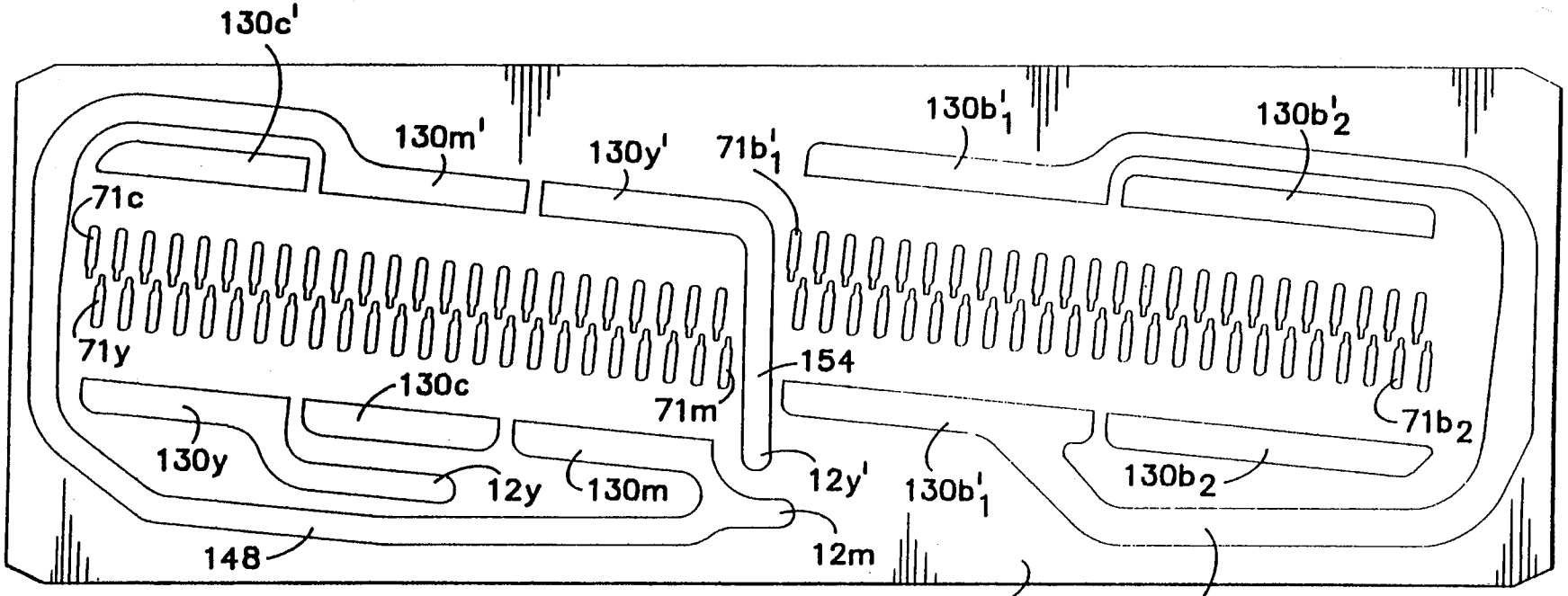
Figure 12:
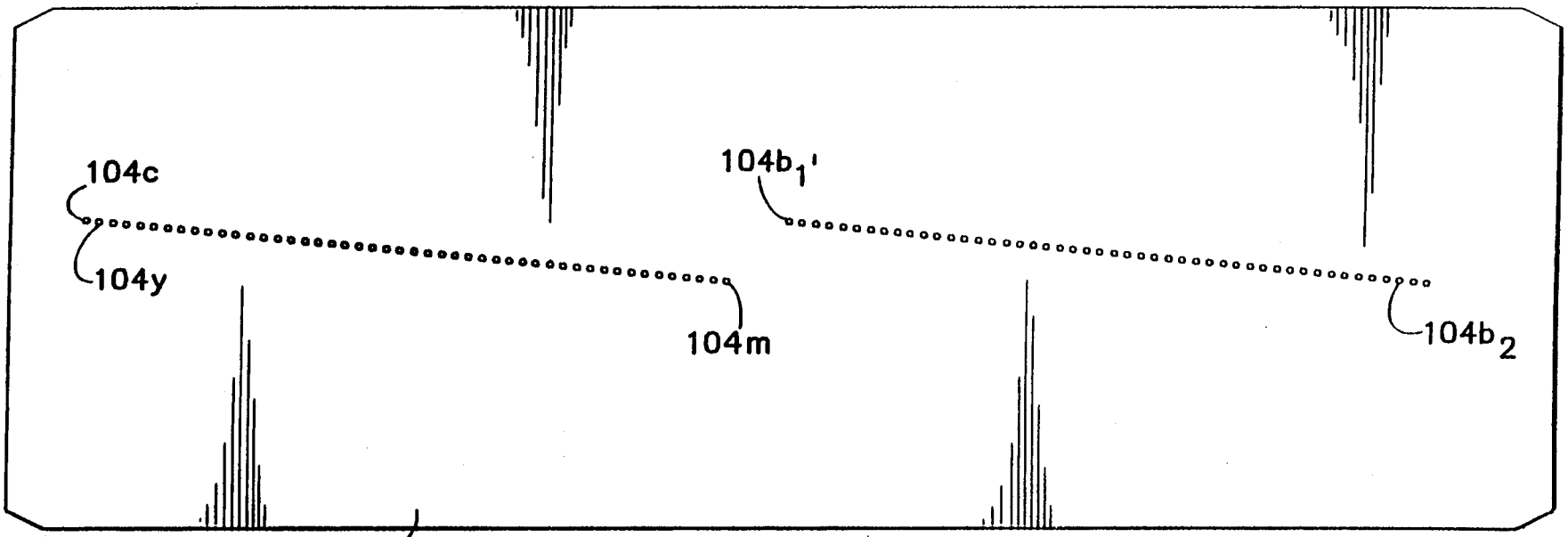

With reference to FIGS. 10 and 11, magenta inlet passage 12*m* is coupled to a communication channel 148 and, by way of this channel, to magenta manifold sections 130*m* and 130*m*'. In addition, yellow ink supply inlet 12*y* is coupled by a channel 150 to manifold section 130*y* (FIG. 10). Furthermore, yellow inlet channel 12*y*' is coupled by a communication channel 154 (FIG. 11) to yellow ink manifold section 130*y*'. In addition, black ink supply inlet 12*b*$_1$ communicates with a passageway 156 in layers 68, 70 (FIGS. 10 and 11) and, by way of this passageway, to black ink manifold sections 130*b*$_1$ and 130*b*$_1$'.

Each of the ink manifold sections is supplied with ink as described above. Also, the volume of the individual manifold sections is increased by including portions of the manifold sections in multiple layers.

For purposes of further illustration, delivery of ink from these manifolds to selected cyan and yellow ink pressure chambers 22c and 22y is described. Also, the flow of ink from these illustrative ink pressure chambers, 22c and 22y, to their associated nozzles/outlets, 14c and 14y, is described. From this description, the flow path of ink to the other pressure chambers and nozzles/outlets will be readily apparent.

With reference to FIGS.. 9 and 10, ink from cyan manifold section 130c' flows into an ink inlet 132c of an ink supply channel 102c. Ink flows from channel 102c through an ink pressure chamber supply inlet 20c (layers 66, 64, FIGS. 9 and 8) and into the upper portion of ink pressure chamber 22c (layer 62, FIG. 7). Ink passes across ink pressure chamber 22c, exits therefrom by way of a passageway 100c (layers 64, 66 and 68, FIGS. 8, 9 and 10) and flows to the upper end of an offset channel 71c (layer 70, FIG. 11). From the lower end of offset channel 71c, ink flows through an opening 104c (layer 72, FIG. 12) to an associated nozzle/outlet 14c (layer 76, FIG. 13).

In the same manner, ink from yellow ink manifold section 130y (FIG. 10) enters an inlet 132y (FIG. 9) of an ink supply channel 102y. From ink supply channel 102y, ink flows through a passageway 20y (layers 66 and 64, FIGS. 9 and 10) to the upper portion of ink pressure chamber 22y. From the lower portion of the ink pressure chamber, ink flows through a passageway 100y (layers 64, 66 and 68, FIGS. 8, 9 and 10) to the upper end of offset channel 71y (layer 70, FIG. 11). From the lower end of this offset channel, ink flows through an opening 104y (layer 72, FIG. 12) to nozzle/outlet 14y (layer 76, FIG. 13). In the same manner, the ink supply to and from pressure chambers 22m, 22$b_1$ and 22$b_2$ may be indicated with numbers corresponding to the numbers used above and with the respective identifiers m, $b_1$ and $b_2$.

Figure 13:
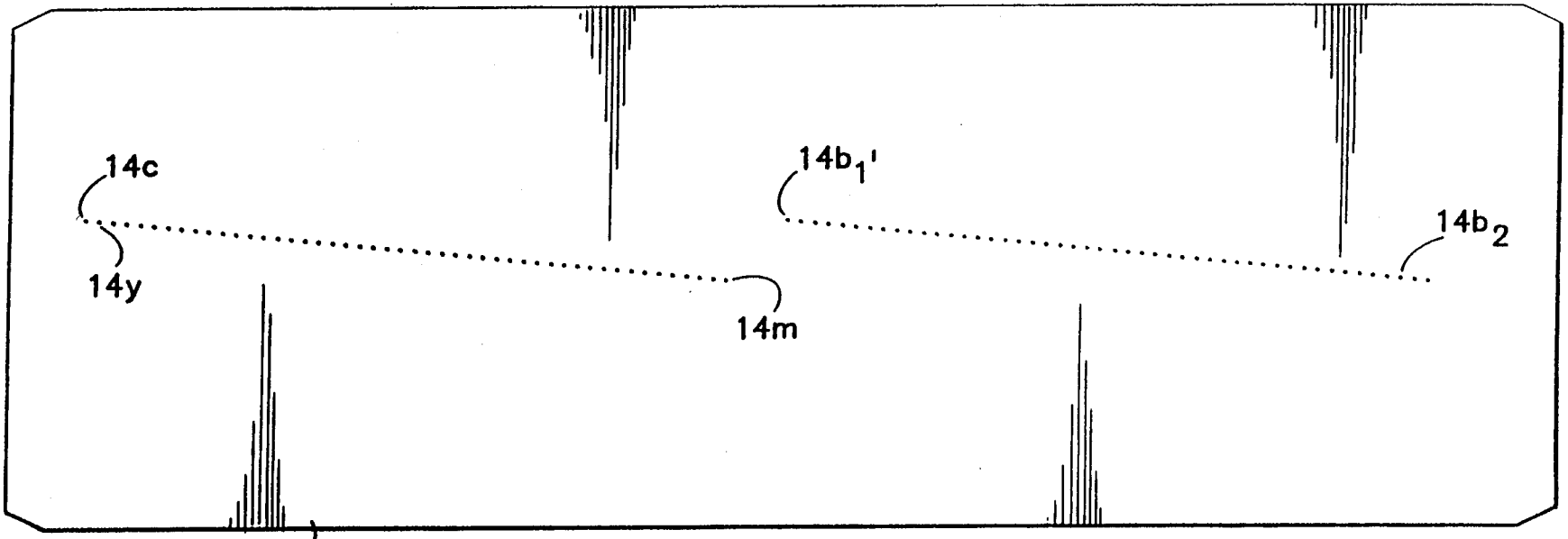

Referring to FIGS. 4, 11 and 13, with the manifold arrangement described above, the 48 offset channels in the right-hand array of FIG. 11 are supplied with black ink as well as the 48 nozzles/outlets in FIG. 13 which are included in the right-hand row of nozzles/outlets of orifice plate 76. In addition, the first eight offset channels of the upper row of offset channels in the left-hand offset channel array of FIG. 11 are supplied with cyan ink; the next eight offset channels in this row are supplied with magenta ink; and the third group of eight offset channels in this row are supplied with yellow ink. Further, the first eight offset channels in the lower row of this left-hand offset channel array are supplied with yellow ink; the next eight offset channels of this lower row are supplied with cyan ink; and the last group of eight offset channels of this lower row are supplied with magenta ink.

Because of the interleaved nature of the upper ends of the lower offset channels and the lower ends of the upper offset channels of FIG. 11, the nozzles/outlets of ink jet print heads of this construction (FIG. 13) are supplied with interleaved colors of ink. That is, adjacent nozzles/outlets in the left-hand row of nozzles/outlets in FIG. 13 are each supplied with a different color of ink. This facilitates color printing as the vertical spacing between nozzles/outlets of a given color of ink is at least two addresses apart. The manifolding and ink supply arrangements can be easily modified to alter the interleaved arrangement of nozzle/outlet colors as desired.

FIG. 4 therefore illustrates a compact, easily manufacturable and advantageous ink jet print head that may be constructed in accordance with the present invention to be less susceptible to rectified diffusion and therefore capable of extended periods of continuous, reliable operation.

Figure 14:
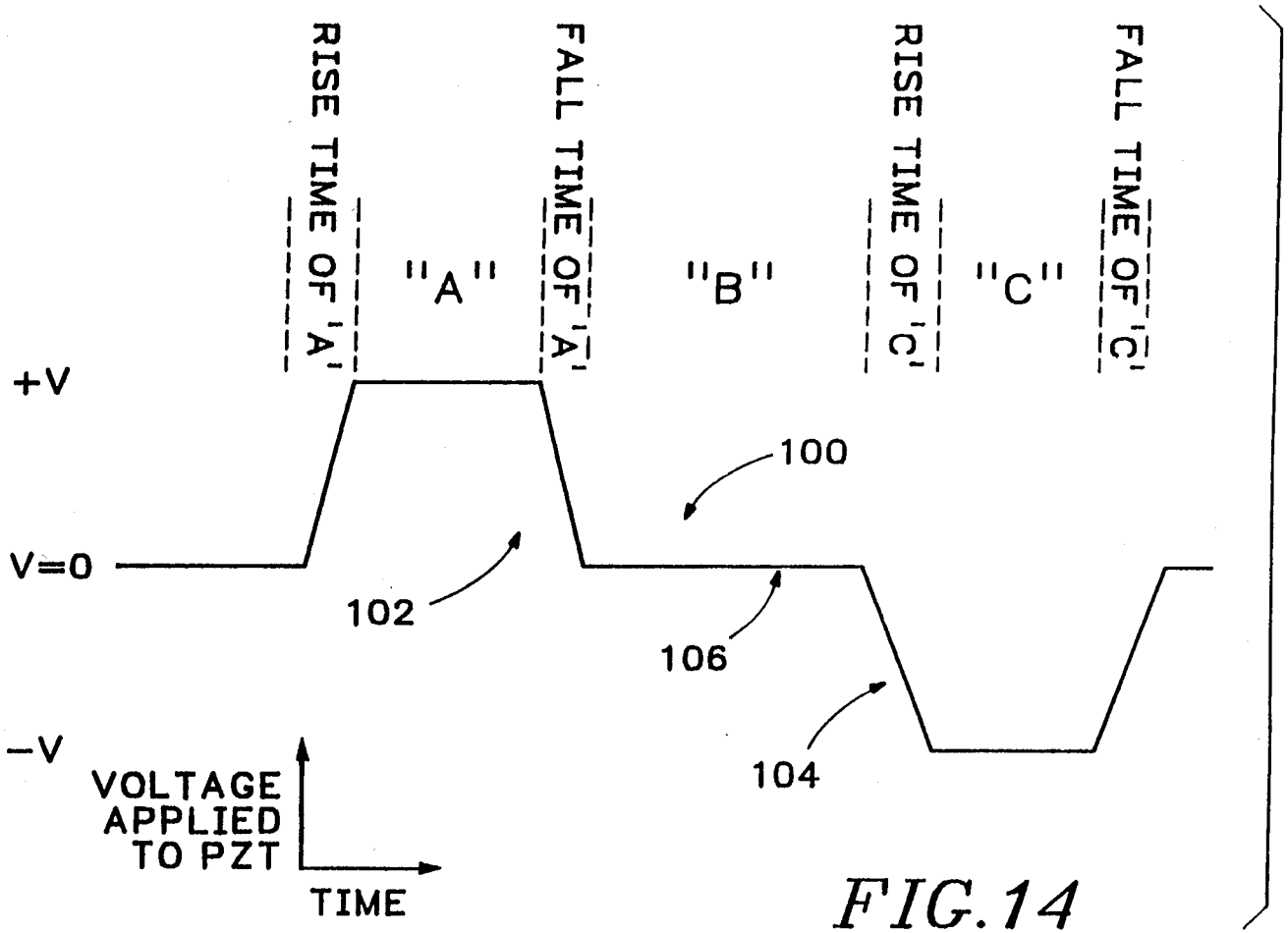
FIG. 14 illustrates a drive signal useful for an acoustic driver of an ink jet print head of the present invention.
Figure 15:
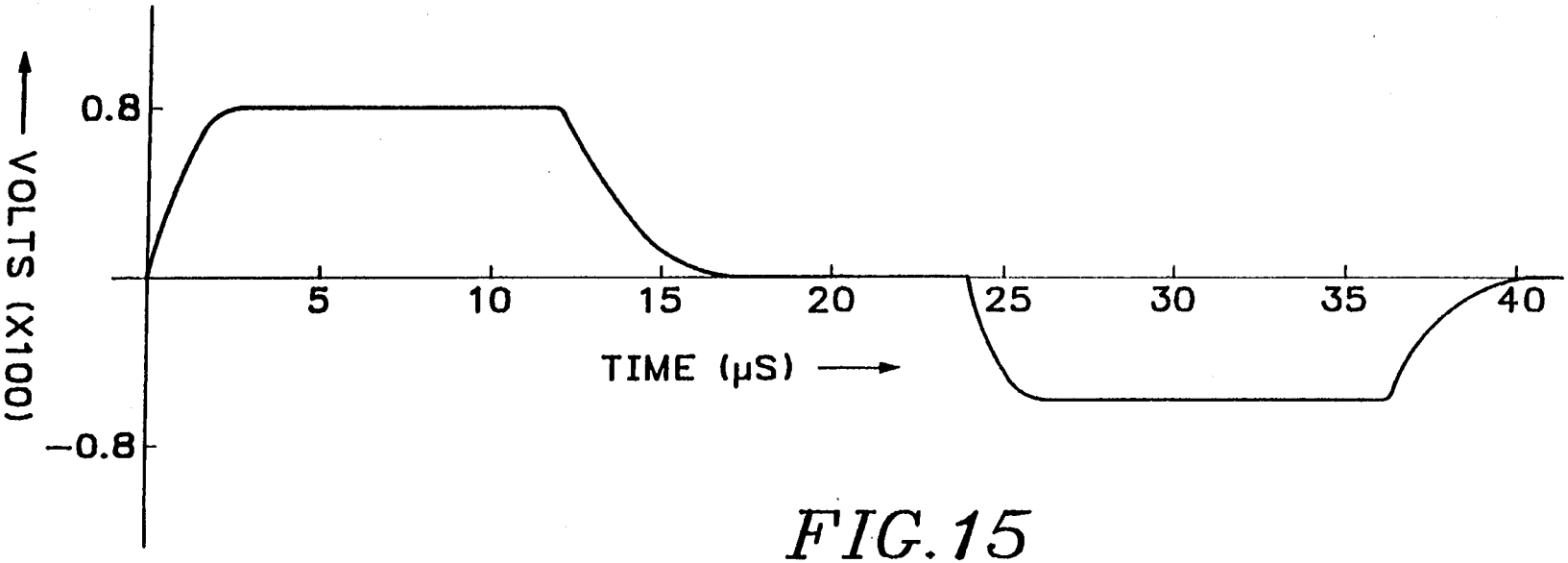
FIG. 15 illustrates a preferred drive signal useful for an acoustic driver of an ink jet print head of the present invention.

An example of a drive signal generated by the electronic circuit driver (voltage source 37 in FIG. 1) to control the operation of ink jet print heads 9 utilizing an acoustic drive mechanism 33, is illustrated in FIG. 14. A preferred, modified drive signal for use in the practice of the present invention is shown in FIG. 15. The drive signals of FIGS. 14 and 15 are discussed in U.S. Pat. No. 5,155,498 issued Oct. 13, 1992 and entitled "Method of Operating an Ink Jet to Reduce Print Quality Degradation Resulting from Rectified Diffusion," which is incorporated by reference herein in its entirety.

The FIG. 14 drive signal is a bipolar electrical pulse 100, with a refill pulse component 102 and an ejection pulse component 104. A preferred embodiment of the drive signal is composed of bipolar electrical signal 100 with refill and ejection pulse components 102, 104 varying about a zero voltage amplitude maintained during wait period 106. The drive signal may also include pulse components 102, 104 of opposite relative polarity varying about a positive or negative reference voltage amplitude maintained during wait period 106.

In operation of ink jet print head 9, utilizing the drive signal described above, ink pressure chamber 22 expands upon application of refill pulse component 102 and draws ink into ink pressure chamber 22 from ink source 11 to refill ink pressure chamber 22 following the ejection of a drop. As the voltage falls toward zero at the end of refill pulse component 102, ink pressure chamber 22 begins to contract and moves the ink meniscus forward in ink orifice 93 (FIG. 3) toward nozzle/outlet 14. During wait period 106, the ink meniscus continues toward nozzle/outlet 14. Upon application of ejection pulse component 104, ink pressure chamber 22 rapidly constricts to cause the ejection of a drop of ink. After the ejection of the ink drop, the ink meniscus is once again drawn back into ink orifice 93 away from nozzle/outlet 14, as a result of application of refill pulse component 102.

The time duration of refill pulse component 102, including rise and fall times, is less than the time required for the ink meniscus to return to a position adjacent to nozzle 14 for ejection of a drop of ink. Typically, the time duration of refill pulse component 102, including rise time and fall time, is less than one-half of the time period associated with the resonant frequency of the ink meniscus. More preferably, this duration is less than about one-fifth of the time period associated with the resonant frequency of the ink meniscus. The resonant frequency of an ink meniscus in an orifice of an ink jet print head can be easily calculated from the properties of the ink, including the volume of the ink inside the ink jet print head, and the dimensions of the orifice in a known manner.

As the time duration of wait period 106, "B," increases, the ink meniscus moves closer to nozzle 14 at the time ejection pulse component 104 is applied. In general, the time duration of wait period 106 and of ejection pulse component 104, including the rise time and fall time of ejection pulse component 104, is less than about one-half of the time period associated with the resonant frequency of the ink meniscus.

A drive signal composed of pulses of the form shown in FIG. 14 is repeatedly applied to cause the ejection of ink drops. One or more pulses may be applied to form each drop. In a preferred embodiment, however, at least one such composite drive signal is used to form each of the drops. In addition, the time duration of wait period 106 is typically set to allow the ink meniscus in ink orifice 93 to advance to substantially the same position within orifice 93 before contraction of ink pressure chamber 22 to eject a drop. By positioning the ink meniscus at substantially the same position prior to application of pressure pulse 104, uniformity of drop flight time to the print medium is enhanced over a wide range of drop ejection rates.

It is also preferable that the ink meniscus have a remnant of forward velocity within ink orifice 93 toward nozzle/outlet 14 when the pressure pulse responsive to ejection pulse component 104 of FIG. 14 arrives. Under these conditions, the fluid ejected from ink jet print head 9 properly coalesces into a drop, thereby minimizing the formation of satellite drops. The ink meniscus should not advance beyond nozzle/outlet 14.

Exemplary durations of the various pulse components for achieving high print quality and high printing rates are 5 microseconds for the "A" portion of the refill pulse component 102, with rise and fall times of respectively 1 microsecond and 3 microseconds; a time duration of wait period 106, "B" of 15 microseconds; and an ejection pulse component 104, with a "C" portion of 5 microseconds and with rise and fall times like those of refill pulse component 102.

FIG. 15 illustrates a preferred, modified drive signal useful in the practice of the present invention. This modified drive signal applies below-ambient pressure to the ink at magnitudes less than the threshold value for the onset of rectified diffusion. Either refill pulse component 102 or ejection pulse component 104, and preferably both, of a preferred modified drive signal exhibit greater time durations at their respective voltage magnitudes, which magnitudes are also preferably reduced. In addition, either, preferably both, of the rise or fall times of pulse components 102 and 104 are extended. The magnitude of the voltage of refill pulse component 102 is reduced with respect to the magnitude of ejection voltage component 104.

At high drop repetition rates, increased flow resistance may result in the inability of the modified refill pulse component 102 to properly refill pressure chamber 22, however. Under those conditions, the ratio of the magnitude of the voltage of refill pulse component 102 to the magnitude of the voltage of ejection pulse component 104, the aspect ratio, is therefore preferably between about 1.15 and about 1.3.

The drive signal of FIG. 15 exhibits a refill pulse component 102 voltage magnitude that is approximately 1.4 times that of the voltage magnitude of ejection pulse 104. The magnitude of the voltage of refill pulse 102 is approximately 50% of that of an unmodified drive signal for the same acoustic driver. The modified preferred drive signal depicted in FIG. 15 exhibits greater pulse component 102, 104 durations at their respective voltage amplitudes as well as rise and fall times of almost 2 times the duration, as compared to those of an unmodified drive signal for the same acoustic driver.

Finally, the present invention is applicable to ink jet print heads 9 using a wide variety of inks. Inks that are liquid at room temperature, as well as inks of the phase change type which are solid at room temperature, may be used. One example of a suitable phase change ink is disclosed in U.S. Pat. No. 4,889,560, issued Dec. 26, 1989 and entitled, "Phase Change Ink Carrier Composition and Phase Change Ink Produced Therefrom."

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein may be varied considerably without departing from the basic principles of the invention.

What is claimed is:

1. A drop on demand ink jet printer having an array of ink jets for receiving ink from an ink supply and for ejecting drops of ink toward a print medium by deflection of a diaphragm forming a wall of an ink pressure chamber, comprising:

a plurality of driving members characterized by an ink-contacting pressure-generating surface of the deflectable diaphragm that has been electropolished to reduce surface defect density and the number of nucleation sites available for gas bubble formation and gas bubble growth in the ink from pressure pulses between negative and positive pressure applications, thereby rendering the drop on demand ink jet printer capable of an extended period of continuous operation substantially free of printing quality degradation resulting from rectified diffusion and requiring electro-polishing of no more than one surface of one component of each ink jet.

2. A drop on demand ink jet printer according to claim 1, wherein the member characterized by an ink-contacting pressure-generating surface is a diaphragm of a piezoelectric ceramic/diaphragm drive mechanism.

3. A drop on demand ink jet printer according to claim 2, wherein the diaphragm is formed of stainless steel.

4. A drop on demand ink jet printer according to claim 2, wherein the diaphragm is electropolished to a range of about one to about six microns.

5. A drop on demand ink jet printer according to claim 2, wherein the diaphragm is electropolished to about two microns.

6. A drop on demand ink jet printer according to claim 2, wherein the diaphragm ranges from about 1 mil to about 10 mils in thickness.

7. A drop on demand ink jet printer according to claim 2, wherein the diaphragm ranges from about 2.5 mils to about 5 mils in thickness.

8. A drop on demand ink jet printer according to claim 2, wherein the piezoelectric ceramic/diaphragm drive mechanism is circular in shape and operates in bending mode.

9. A drop on demand ink jet printer according to claim 2, wherein the piezoelectric ceramic/diaphragm drive mechanism is hexagonal in shape and operates in bending mode.

10. A drop on demand ink jet printer according to claim 2, wherein the piezoelectric ceramic/diaphragm drive mechanism is rectangular in shape and operates in bending mode.

11. A drop on demand ink jet printer according to claim 2, comprising 96 piezoelectric ceramic/diaphragm drive mechanisms.

12. A drop on demand ink jet printer according to claim 2 wherein the electropolishing step is conducted in the presence of an effective amount of FLUORAD FC 95.

13. The ink jet printer of claim 1 in which the ink is substantially saturated with a gas.

14. The ink jet printer of claim 1 in which the period of continuous operation is at a repetition rate up to about 11,000 drops per second.

* * * * *